US011349184B2

(12) United States Patent
Kim et al.

(10) Patent No.: US 11,349,184 B2
(45) Date of Patent: May 31, 2022

(54) PHASE SHIFTER INCLUDING FIRST AND SECOND BOARDS HAVING RAILS THEREON AND CONFIGURED TO BE ROTATABLE WITH RESPECT TO EACH OTHER AND AN ANTENNA FORMED THEREFROM

(71) Applicant: Samsung Electronics Co., Ltd., Suwon-si (KR)

(72) Inventors: Young-Jong Kim, Anyang-si (KR); Dongsik Shin, Suwon-si (KR); Jonghwa Kim, Seoul (KR); Hae-Gweon Park, Suwon-si (KR); Byungtae Yoon, Suwon-si (KR); Jong Wook Zeong, Suwon-si (KR); Soon-Ho Hwang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 24 days.

(21) Appl. No.: 16/651,843

(22) PCT Filed: Sep. 11, 2018

(86) PCT No.: PCT/KR2018/010619
§ 371 (c)(1),
(2) Date: Mar. 27, 2020

(87) PCT Pub. No.: WO2019/066308
PCT Pub. Date: Apr. 4, 2019

(65) Prior Publication Data

US 2020/0251797 A1 Aug. 6, 2020

(30) Foreign Application Priority Data

Sep. 27, 2017 (KR) ..... 10-2017-0125219

(51) Int. Cl.
*H01P 1/18* (2006.01)
*H01Q 3/36* (2006.01)
*H01Q 3/32* (2006.01)

(52) U.S. Cl.
CPC ..... *H01P 1/184* (2013.01); *H01P 1/18* (2013.01); *H01Q 3/32* (2013.01); *H01Q 3/36* (2013.01)

(58) Field of Classification Search
CPC ... H01P 1/184; H01P 1/18; H01P 9/00; H01Q 3/34; H01Q 3/36; H01Q 3/32
(Continued)

(56) References Cited

U.S. PATENT DOCUMENTS 7,233,217 B2 * 6/2007 Phillips et al. ..... H01P 1/184 333/116
7,589,603 B2 9/2009 Tae et al.
(Continued)

FOREIGN PATENT DOCUMENTS

KR 10-2005-0008882 A 1/2005
KR 10-2010-0001348 A 1/2010
(Continued)

OTHER PUBLICATIONS

International Search Report dated Dec. 20, 2018 in connection with International Patent Application No. PCT/KR2018/010619, 2 pages.
(Continued)

*Primary Examiner* — Benny T Lee

(57) ABSTRACT

The present disclosure relates to a pre-5$^{th}$-Generation (5G) or 5G communication system to be provided for supporting higher data rates beyond 4$^{th}$-Generation (4G) communication system such as long-term evolution (LTE). A phase shifter device according to various embodiments of the present disclosure may include: a first board configured to comprise a phase changing rail; and a second board config-
(Continued)

ured to comprise an input rail connected to an input port, a first output rail connected to a first output port, a second output rail connected to a second output port, and a connection rail connecting the first output rail with the second output rail. The first board may be disposed to be spaced a predetermined distance apart from the second board so as to face and overlay the second board. The phase of a signal passing through a first section of the connection rail may vary by a first value depending on the rotation of the first board. The signal may be divided into a first signal transmitted to the first output port and a second signal transmitted to the second output port.

13 Claims, 32 Drawing Sheets

(58) Field of Classification Search
USPC ..... 333/161
See application file for complete search history.

(56) References Cited

U.S. PATENT DOCUMENTS 8,841,977 B2 9/2014 Jung et al.
10,854,938 B2 * 12/2020 Kim et al. ..... H01Q 21/22
2006/0077098 A1 * 4/2006 Zimmerman ..... H01Q 1/246 342/372
2006/0164185 A1 7/2006 Tae et al.
2010/0219907 A1 * 9/2010 Kim et al. ..... H01P 1/184 333/161
2011/0095841 A1 * 4/2011 Jung et al. ..... H01P 1/18 333/100
2012/0056692 A1 3/2012 Moon et al.
2016/0301121 A1 * 10/2016 Dandlberger et al. .... H01P 5/12

FOREIGN PATENT DOCUMENTS

KR 10-1075983 B1 10/2011
KR 10-1223747 B1 1/2013
KR 10-2015-0005305 A 1/2015

OTHER PUBLICATIONS

Written Opinion of the International Searching Authority dated Dec. 20, 2018 in connection with International Patent Application No. PCT/KR2018/010619, 6 pages.
Notice of Preliminary Rejection dated Jan. 4, 2022, in connection with Korean Application No. 10-2017-0125219, 13 pages.

* cited by examiner

PHASE SHIFTER INCLUDING FIRST AND SECOND BOARDS HAVING RAILS THEREON AND CONFIGURED TO BE ROTATABLE WITH RESPECT TO EACH OTHER AND AN ANTENNA FORMED THEREFROM

CROSS-REFERENCE TO RELATED APPLICATIONS

This application is a 371 of International Application No. PCT/KR2018/010619 filed on Sep. 11, 2018, which claims priority to Korean Patent Application No. 10-2017-0125219 filed on Sep. 27, 2017, the disclosures of which are herein incorporated by reference in their entirety.

BACKGROUND

1. Field

The present disclosure relates generally to antenna devices and, more particularly, to antenna devices that include phase shifters.

2. Description of Related Art

In domestic and foreign mobile communication systems, the density of subscribers varies by region and time zone, so that the network management is performed to adjust the coverage of the base station by adjusting the vertical beam angle of the base station antenna to provide an optimal service in such a situation.

To this end, the conventional beam communication system uses a mechanical beam tilt method. Such a mechanical tilt method is a method of directly adjusting the direction of an antenna radiation beam by adjusting an angle of an antenna using a mechanical beam tilt device mounted to an antenna.

An advantage of the mechanical beam tilt method is that the production cost of the antenna can be lowered. However, for the base station to operate, there is a risk of an accident due to a fall and the speed of repair may decrease by taking a lot of time to repair because a technician goes directly to the base station antenna tower to unscrew the bolts holding the beam tilt mechanism, change the angle of the antenna, and then tighten the bolts again.

In order to solve this problem, an electric beam tilt method for remotely adjusting the beam tilt of the base station antenna has been developed. The electric beam tilt antenna has a phase shifter for adjusting the phase of the beam therein.

Based on the discussion as described above, the present disclosure provides an antenna device that includes a phase shifter.

In addition, the present disclosure, in changing the phase of the signal transmitted to each output port according to the rotation of the first board, one output port included in the second board using one connection line included in the second board in addition to the phase of the signal to be delivered to the phase shifter for adjusting the phase of the signal transmitted to the other output port included in the second board.

SUMMARY OF THE INVENTION

According to various embodiments of the present disclosure, a phase shifter device may include: a first substrate configured to include a phase changing rail; and a second substrate configured to include an input rail connected to an input port, a first output rail connected to a first output port, a second output rail connected to a second output port, and a connection rail connecting the first output rail with the second output rail. The first substrate may be disposed to be spaced a predetermined distance apart from the second substrate so as to face and overlay the second substrate. The phase of a signal passing through a first section of the connection rail may vary by a first value depending on the rotation of the first substrate. The signal may be divided into a first signal transmitted to the first output port and a second signal transmitted to the second output port.

According to various embodiments of the present disclosure, an antenna device may include: a housing; a first radiating element and a second radiating element configured to be disposed inside the housing; and a phase shifter configured to be disposed inside the housing. The phase shifter may include a first substrate configured to include a phase changing rail and a second substrate configured to include an input rail connected to an input port, a first output rail connected to a first output port, a second output rail connected to a second output port, and a connection rail connecting the first output rail with the second output rail. The first substrate may be disposed to be spaced a predetermined distance apart from the second substrate so as to face and overlay the second substrate. The phase of a signal passing through a first section of the connection rail may vary by a first value depending on the rotation of the first substrate. The signal may be divided into a first signal transmitted to the first output port and a second signal transmitted to the second output port.

The device according to various embodiments of the present disclosure has a structure capable of adjusting the phases of respective signals transmitted to different output ports using a single connection line, thereby reducing the size of a phase shifter.

Effects which can be acquired by the present disclosure are not limited to the above described effects, and other effects that have not been mentioned may be clearly understood by those skilled in the art from the following description.

DETAILED DESCRIPTION OF THE INVENTION

Figure 1A:
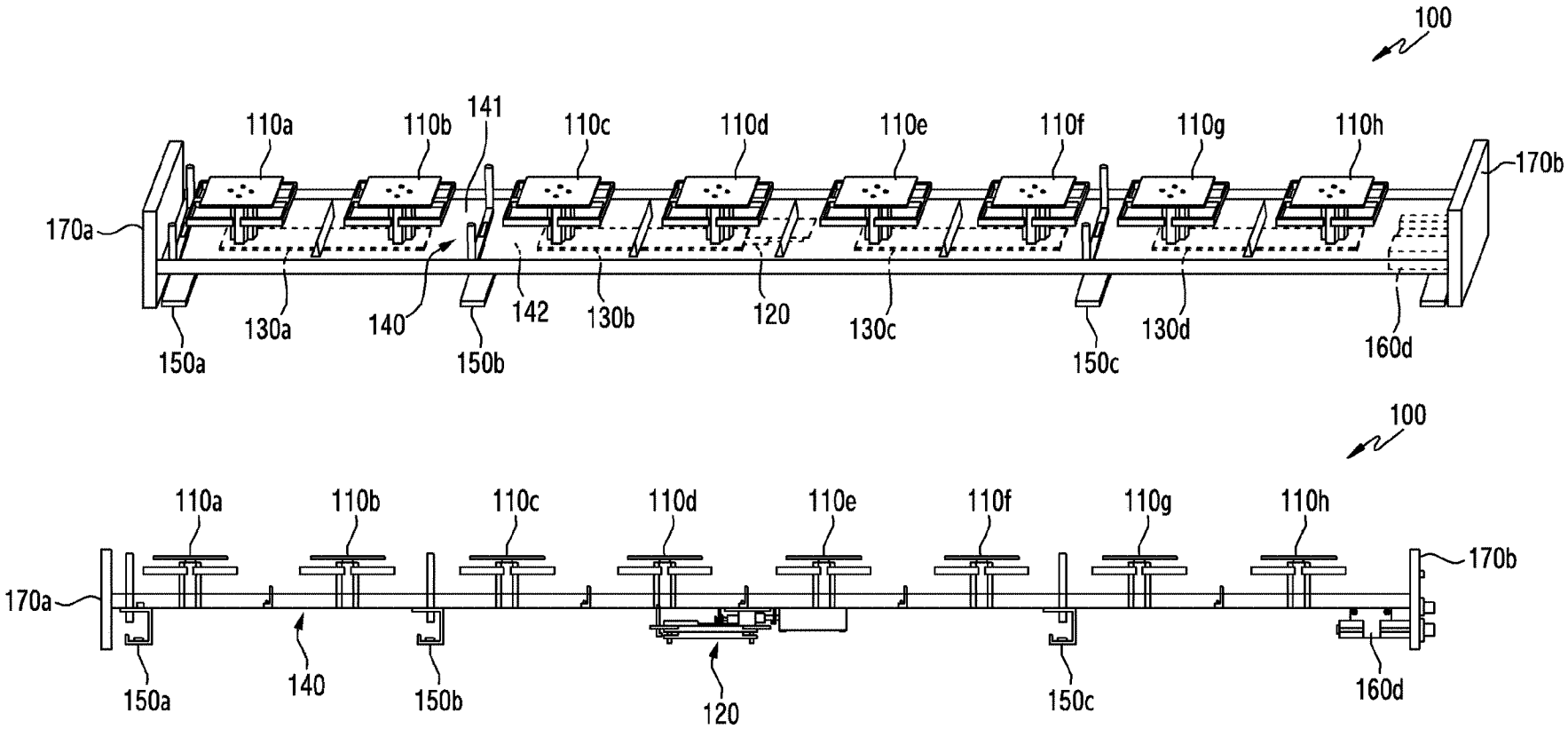
FIG. 1A illustrates a perspective view and a front view of a beam-tilt antenna according to various embodiments of the present disclosure.

The terms used in the present disclosure are only used to describe specific embodiments, and are not intended to limit other embodiments. Singular expressions may include plural expressions as well unless the context clearly indicates otherwise. All terms used herein including technical and scientific terms may have the same meaning as those commonly understood by a person skilled in the art to which the present disclosure pertains. Terms such as those defined in a generally used dictionary among the terms used in the present disclosure may be interpreted to have the meanings equal or similar to the contextual meanings in the relevant field of art, and are not to be interpreted to have ideal or excessively formal meanings unless clearly defined in the present disclosure. In some cases, even a term defined in the present disclosure should not be interpreted to exclude embodiments of the present disclosure.

In various embodiments of the present disclosure to be described below, a hardware approach will be described as an example. However, since the various embodiments of the present disclosure include a technology using both hardware and software, the various embodiments of the present disclosure do not exclude a software-based approach.

Hereinafter, the present disclosure relates to an antenna device. Specifically, the present disclosure describes a beam tilt antenna device that includes a phase shifter.

Terms used in the following description (e.g., input lines, output lines, transmission lines, phase change lines), terms referring to the components of the apparatus (modified according to the invention as appropriate), etc. are provided for convenience of description. Thus, the present disclosure is not limited to the terms described below, and other terms having equivalent technical meanings may be use.

Hereinafter, various embodiments will be described in detail with reference to the accompanying drawings. However, in the drawings, the size of the components may be exaggerated or reduced for convenience of description. For example, the size and thickness of each component shown in the drawings are arbitrarily shown for convenience of description, and thus the present invention is not necessarily limited to the illustrated.

Figure 1B:
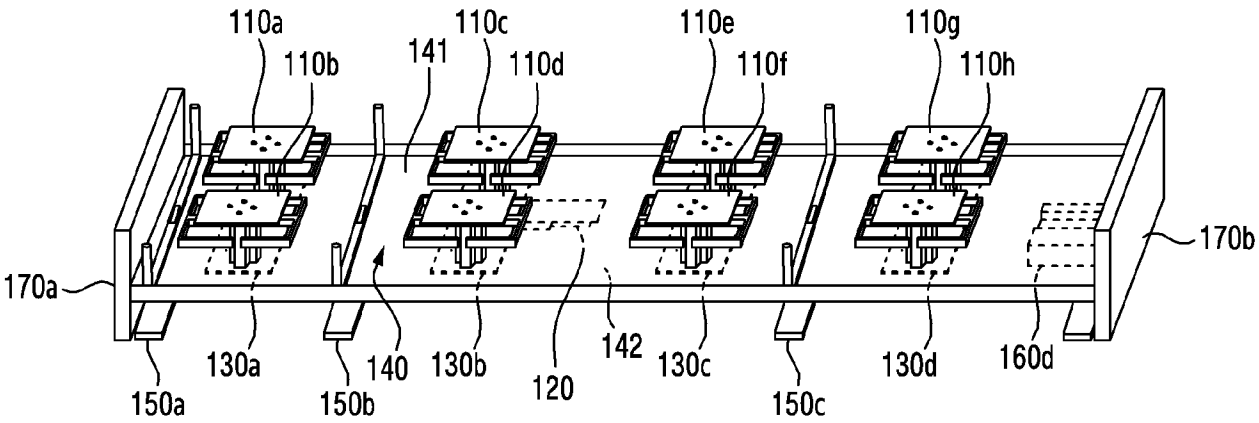
FIG. 1B illustrates another perspective view of a beam-tilt antenna according to various embodiments of the present disclosure.
Figure 1C:
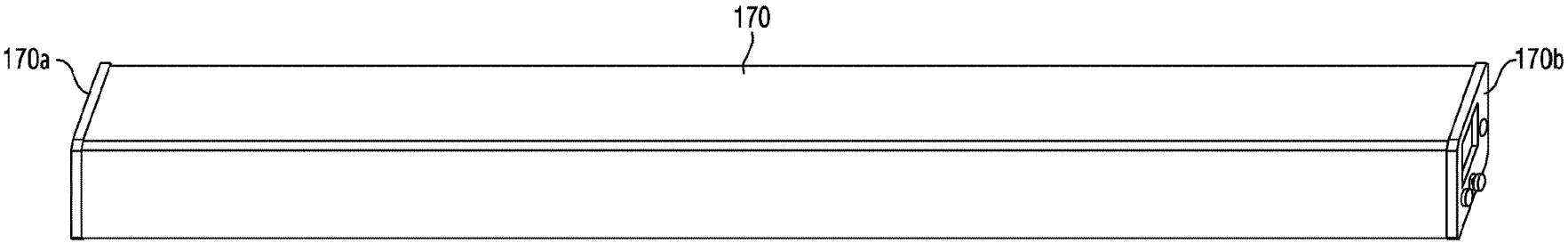
FIG. 1C illustrates a perspective view of a housing of a beam-tilt antenna according to various embodiments of the present disclosure.

FIG. 1A illustrates a perspective view and a front view of a beam tilt antenna according to various embodiments of the present disclosure. FIG. 1B illustrates another perspective view of a beam tilt antenna according to various embodiments of the present disclosure. FIG. 1C is a perspective view of a housing of a beam tilt antenna according to various embodiments of the present disclosure.

According to FIG. 1A to 1C, the beam tilt antenna 100 in FIG. 1A includes a reflector plate 140. The reflector plate 140 in FIG. 1A and FIG. 1B may be fixed by being spaced apart from one surface of the inside of the housing 170 in FIG. 1C by fixing members 150*a*, 150*b*, and 150*c* in FIG. 1A and FIG. 1B. The reflector plate 140 may improve the directivity and the gain of the signal by reflecting the signals emitted from the radiating elements 110*a*, 110*b*, 110*c*, 110*d*, 110*e*, 110*f*, 110*g* and 110*h*, in FIG. 1A and FIG. 1B.

Radiating elements 110*a* to 110*h* in FIG. 1A and FIG. 1B are disposed on the first surface 141 of the reflector plate 140 in FIG. 1A and FIG. 1B. In this case, two adjacent radiating elements among the radiating elements 110*a* to 110*h* (for example, radiating element 110*a* and radiating element 110*b*, radiating element 110*c* and radiating element 110*d*, radiating element 110*e* and radiating element 110*f*, radiating element 110*g* and radiating element 110*h*)) can be configured in pairs to emit the same signal from the same output port. In some embodiments, as shown in FIG. 1A, in the reflector plate 140, the radiating elements 110*a* to 110*h* may be disposed in a 1×8 form. In other embodiments, as shown in FIG. 1B, the reflector plate 140 and the radiating elements 110*a* to 110*h* may be disposed in a 2×4 shape.

The phase shifter 120 in FIG. 1A and FIG. 1B, the conductive members 130*a*, 130*b*, 130*c*, to 130*d* in FIGS. 1A and 1B, and the input/output end 160*d* are disposed on the second surface 142 in FIGS. 1A and 1B of the reflective plate 140. The phase shifter 120 adjusts the phase of the signal input to the input port and delivers the adjusted signal to the output port. The conductive members 130*a* to 130*d* may transmit a phase-adjusted signal output from each output port of the phase shifter 120 to the radiating elements 110*a* to 110*h*. Accordingly, the radiating elements 110*a* to 110*h* emit a signal whose phase is adjusted. That is, the phase shifter 120 controls the radiation pattern (e.g., direction) of the signal output from the radiating elements 110*a* to 110*h* by adjusting the phase of the input signal.

The input/output end 160*d* may receive a signal generated by a processor and a radio frequency (RF) circuit of a transmitter (e.g., a base station) (not shown) including the antenna 100. Thereafter, the input/output end 160*d* may transmit an input signal to the phase shifter 120.

The radiating element 110*a*, the radiating element 110*b*, the phase shifter 120, the conductive member 130*a* to 130*d*, and the input/output end 160*d* disposed on the first surface 141 and the second surface 142 of the reflecting plate 140 are embedded in the housing 170, the cover 170*a*, and the cover 170*b*.

Figure 2A:
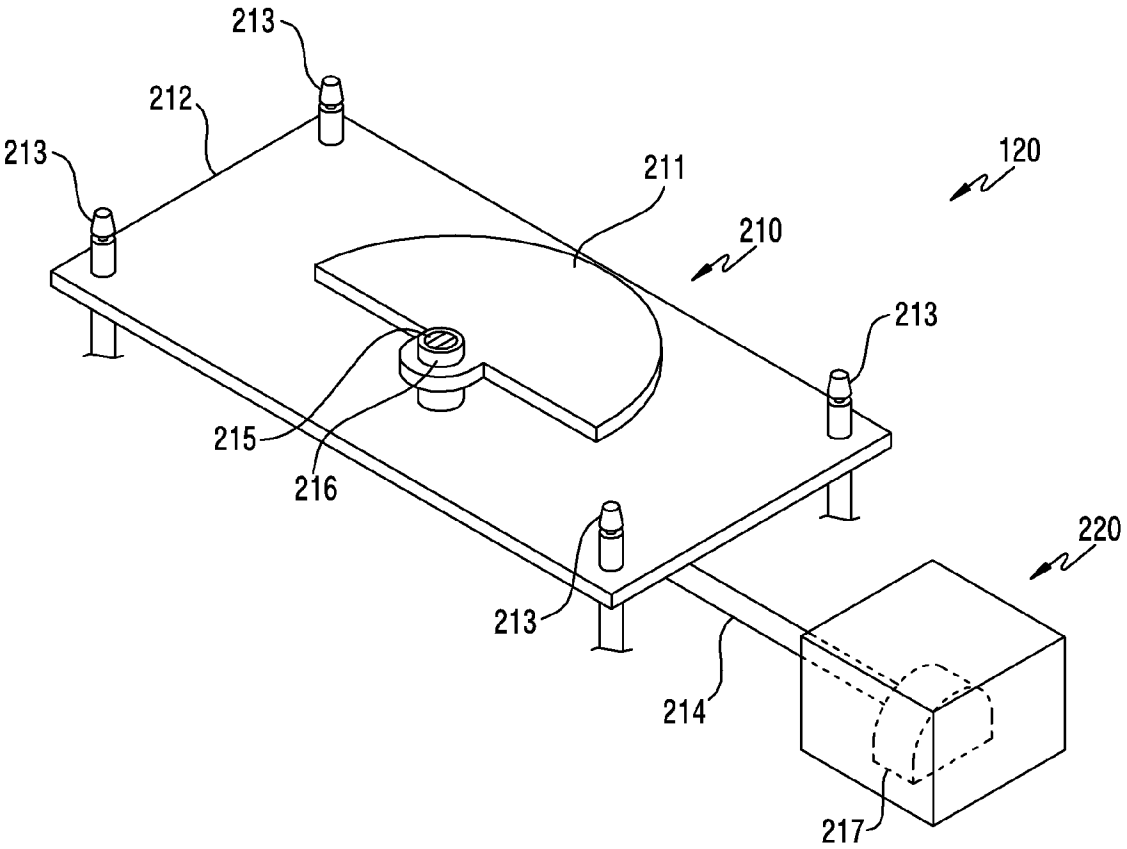
FIG. 2A illustrates a perspective view of a phase shifter according to various embodiments of the present disclosure.
Figure 2B:
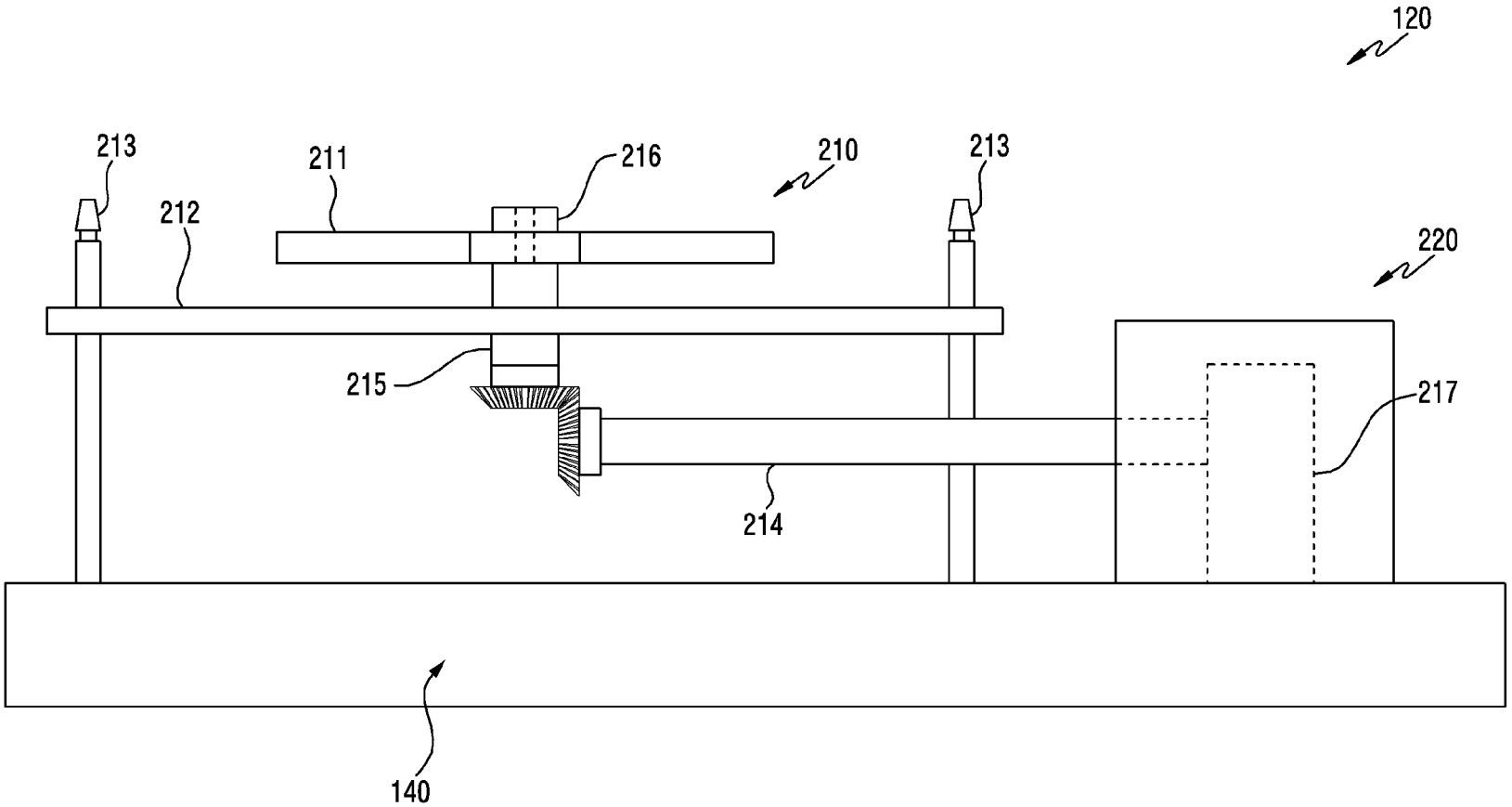
FIG. 2B illustrates a front view of a phase shifter according to various embodiments of the present disclosure.
Figure 2C:
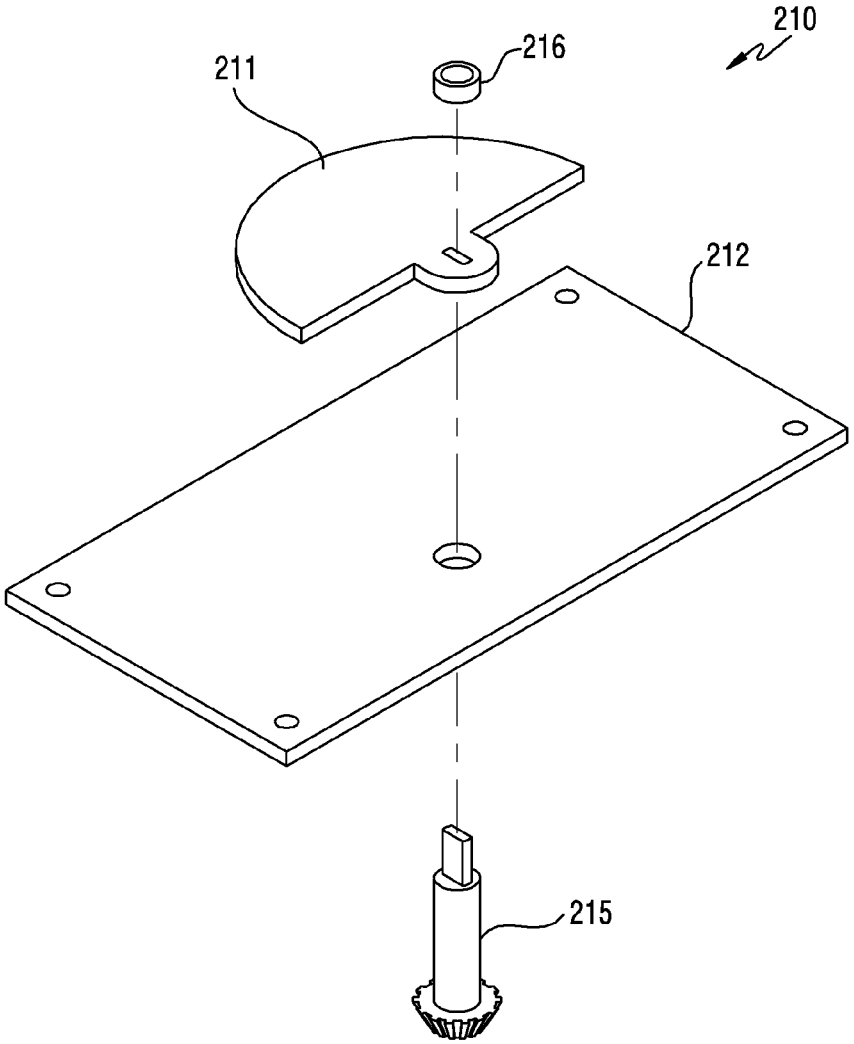
FIG. 2C illustrates an exploded perspective view of a phase changer according to various embodiments of the present disclosure.

FIG. 2A illustrates a perspective view of a phase shifter according to various embodiments of the present disclosure. FIG. 2B illustrates a front view of a phase shifter according to various embodiments of the present disclosure. FIG. 2C illustrates an exploded perspective view of a phase changer according to various embodiments of the present disclosure.

Referring to FIGS. 2A and 2B, the phase shifter 120 includes a phase changer 210 and a driving part 220.

Referring to FIGS. 2A-2C, the phase changer 210 includes a first board 211 and a second board 212 disposed to face each other. For example, the first board 211 and the second board 212 may be referred to as "printed circuit boards (PCBs)". In some embodiments, the first board 211 may be spaced a predetermined distance apart from the second board 212 so as to face and overlay the same.

A first bevel gear 215 is engaged with a second bevel gear 214 in FIGS. 2A and 2B, and the second bevel gear 214 is rotated by a motor 217 in FIGS. 2A and 2B included in the driving part 220, thereby rotating the first bevel gear 215. In this case, a bolt provided at the end of the first bevel gear 215 passes through the first board 211 and the second board 212 so as to engage with a nut 216. Thus, the first board 211 is fixed to the first bevel gear 215, and the first board 211 is rotated by the rotation of the first bevel gear 215. In addition, the second board 212 is fixed to the reflector plate 140 in FIG. 2B by a board fixing piece 213. However, the gear for rotating the first board 211 is not limited to a bevel gear, and various types of gears may be used.

FIGS. 3A to 3D illustrate front views of a phase changer before and after rotation of a first board according to a first embodiment of the present disclosure.

Referring to FIGS. 3A to 3D, the first board 211 includes a phase changing rail 321, a phase changing rail 322, and a phase changing rail 323. The second board 212 includes an input rail 301 connected to an input port, an output rail 302 connected to an output port P1, an output rail 303 connected to an output port P2, an output rail 304 connected to an output port P3, an output rail 305 connected to an output port P4, and connection rail 311 in FIGS. 3A-3C and connections rails 312 and 313. The connection rail 311 may connect the output rail 302 and the output rail 303. The connection rail 312 may be connected to the point where the connection rail 311 and the output rail 303 are connected. The connection rail 313 may be connected to the point where the connection rail 311 and the output rail 302 are connected. The connection rail 311 may include a comb pattern (or comb-shaped) rail. For example, the connection rail 311 may have a comb-line shape. In this case, the phase speed of a signal passing through the connection rail 311 may be slowed by the comb-line shape of the connection rail 311. Thus, the amount of phase change per unit length of the connection rail 311 including the comb-line may be greater than the amount of phase change per unit length of a rail (e.g., the phase changing rail 322 or the phase changing rail 323) that does not include the comb-line. As another example, referring to FIG. 3D, the connection rail 311-1 may include a wave pattern (or wave-shaped) rail. In addition, the connection rail 311 may be formed of various types of rails.

The respective thicknesses of the various rails included in FIGS. 3A to 3D may be designed to be different from each other in order to match impedance between neighboring rails.

Figure 3A:
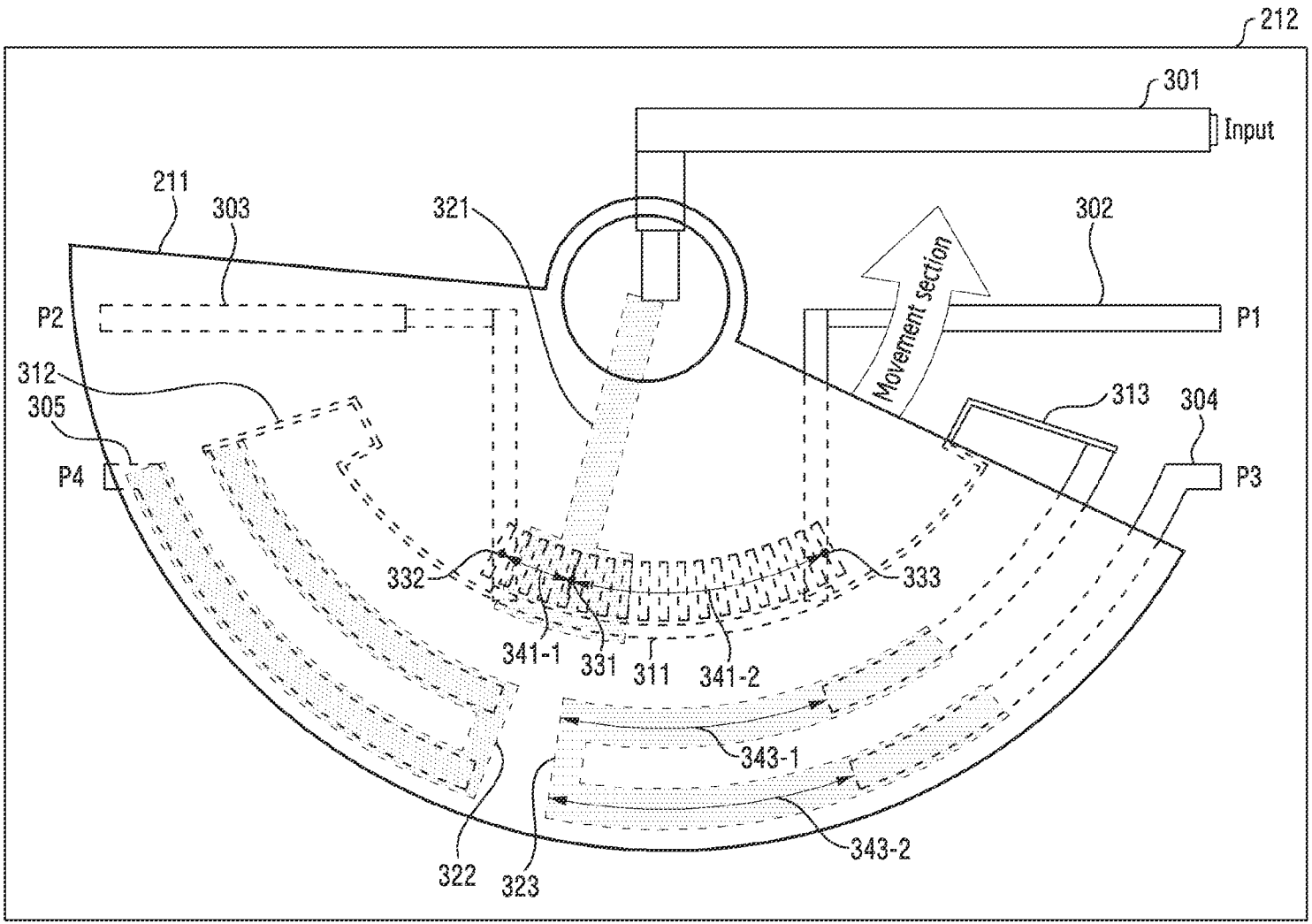
FIGS. 3A to 3D illustrate front views of a phase changer before and after rotation of a first board according to a first embodiment of the present disclosure.
Figure 3B:
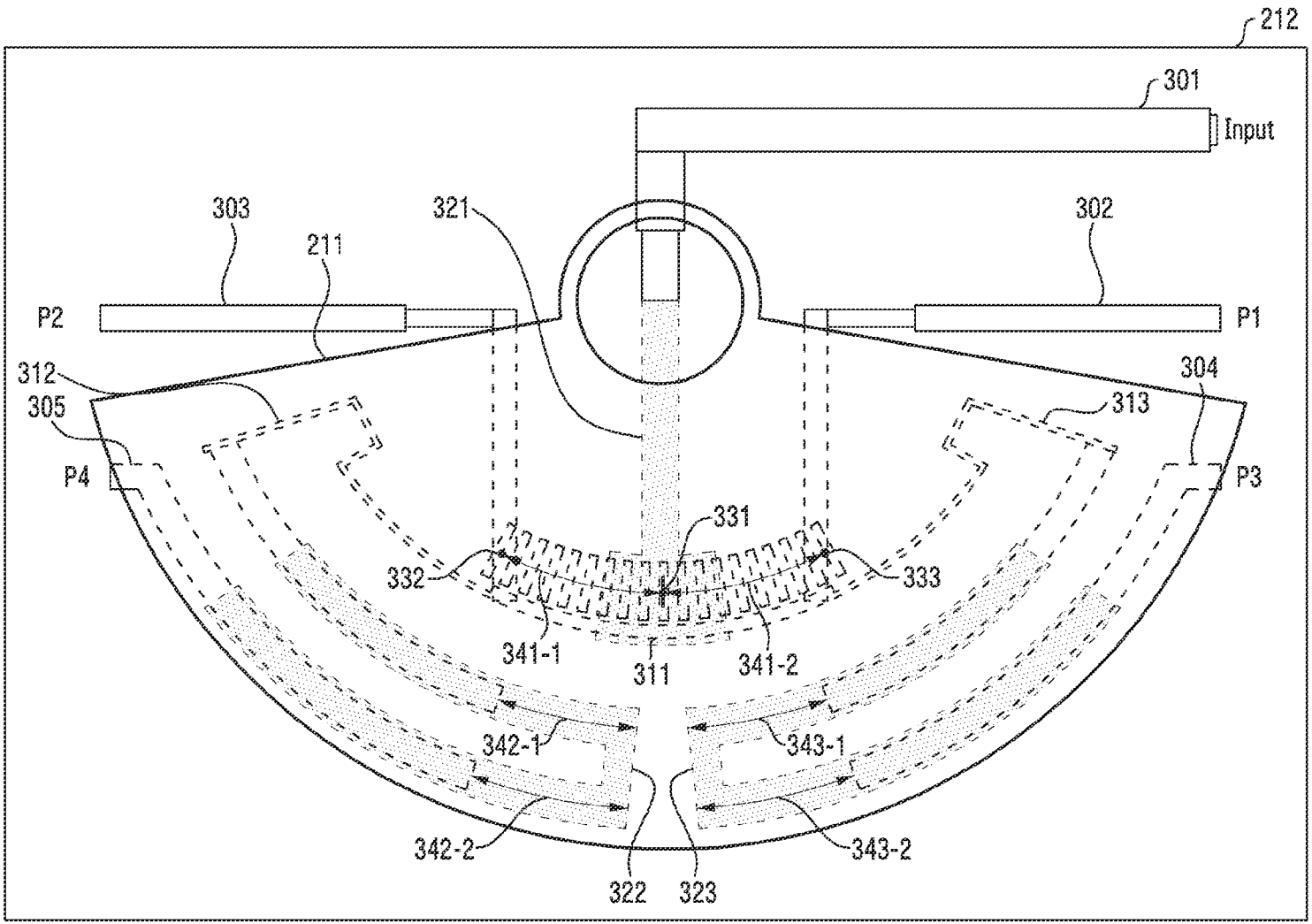
Figure 3C:
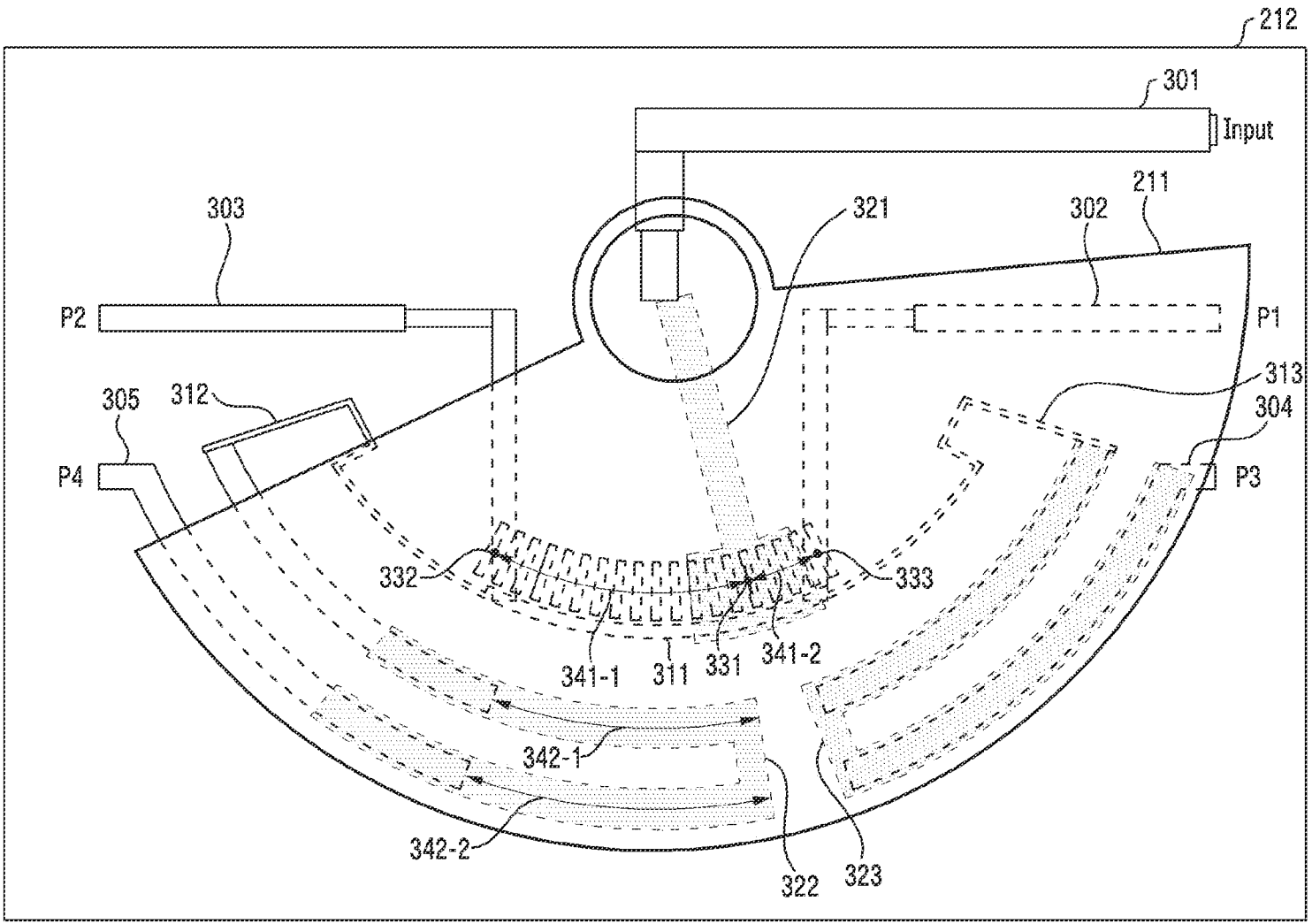
Figure 3D:
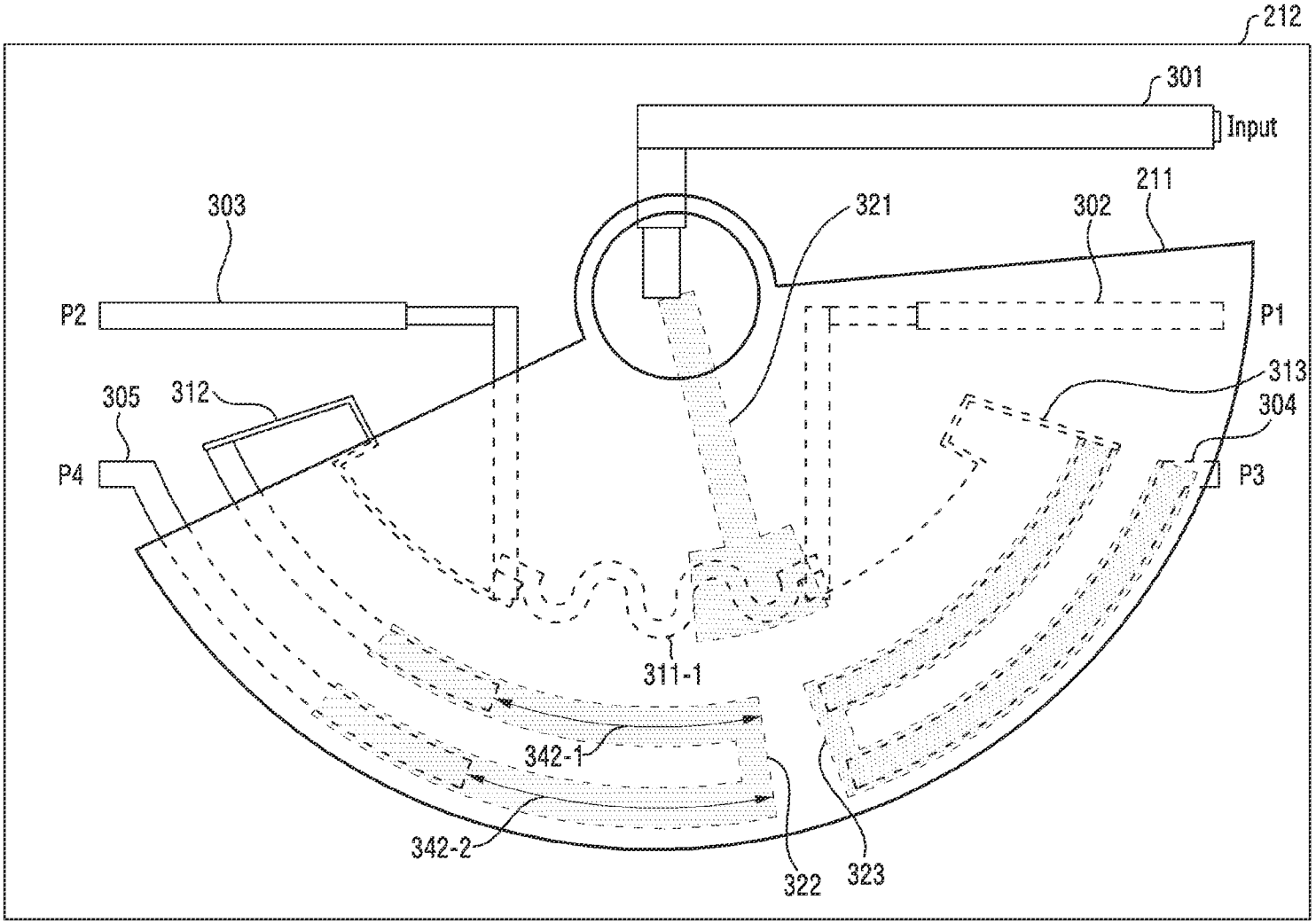

A signal transmitted from the input port and passing through the input rail 301 is divided at a first division point 331 in FIGS. 3A-3C into a signal directed to the output ports P1 and P3 and a signal heading for the output ports P2 and P4. The first division point 331 may refer to the center of the portion where the comb pattern rail of the phase changing rail 321 and the connection rail 311 are coupled to each other.

Thereafter in FIGS. 3A-3C, the signal that has passed through a first section 341-1 of the connection rail 311 and directed to the output ports P2 and P4 is divided again at a second division point 332 into a signal transmitted to the output port P2 and a signal transmitted to the output port P4. The second division point 332 may refer to the point where the connection rail 311, the connection rail 312, and the output rail 303 are connected to each other. In addition, the signal that has passed a second section 341-2 of the connection rail 311 and directed to the output ports P1 and P3 is divided again at a third division point 333 into a signal transmitted to the output port P1 and a signal transmitted to the output port P3. The third division point 333 may refer to the point where the connection rail 311, the connection rail 313, and the output rail 302 are connected to each other. In addition, the first section 341-1 may refer to the portion that ranges from the first division point 331 to the second division point 332 in the connection rail 311. The second section 341-2 may refer to the portion that ranges from the first division point 331 to the third division point 333 in the connection rail 311.

The signal transmitted to the output port P2 passes through the output rail 303, and the signal transmitted to the output port P4 passes through a third section 342-1 in FIG. 3B and FIG. 3C and a fourth section 342-2 in FIG. 3B and FIG. 3C of the connection rail 312. The third section 342-1 may refer to a candidate portion that may be further coupled to the connection rail 312 in the phase changing rail 322 when the first board 211 rotates. The fourth section 342-2 may refer to a candidate portion that may be further coupled to the connection rail 313 in the phase changing rail 323 when the first board 211 rotates.

In some embodiments, when the first board 211 rotates as indicated by the arrow designated as "Movement Section", the third section 342-1 and the fourth section 342-2 may be different from each other in the amount of change in the length thereof because the arc length of the first board 211 varies depending on the radius thereof during the rotation of the first board 211. Thus, as the first board 211 rotates, the amounts of changes in the phases of the signals passing through the third section 342-1 and the fourth section 342-2 may be different. In some embodiments, considering the distance from the rotational axis of the first board 211, the amount of change in the length of the first section 341-1 may be less than those of the third section 342-1 and the fourth section 342-2 when the first board 211 rotates. Thus, in this case, although the connection rail 311 has a comb-line shape, the amount of change in the phase of the signal passing through the first section 341-1 may be less than those of the signals passing through the third section 342-1 and the fourth section 342-2.

The signal transmitted to the output port P1 passes through the output rail 302, and the signal transmitted to the output port P3 passes through a fifth section 343-1 in FIG. 3A and FIG. 3B and a sixth section 343-2 in FIG. 3A and FIG. 3B of the connection rail 313. The fifth section 343-1 may refer to the portion where the coupling with the connection rail 313 is released in the phase changing rail 323 as the first board 211 rotates. The sixth section 343-2 may refer to the portion where the coupling between the output rail 304 and the first board 211 is released in the phase changing rail 323 as the first board 211 rotates.

As the first board 211 rotates, the length of the first section 341-1 increases by the rotation angle of the first board 211. Accordingly, the phase of the signal passing through the first section 341-1 and directed to the output ports P2 and P4 increases by a second phase (β°).

When the first board 211 rotates, the length of the output rail 303 does not vary, so that the phase of the signal transmitted to the output port P2 after the rotation of the first board 211 varies by +β°, compared to that before the rotation of the first board 211.

In addition, as the first board 211 rotates, the lengths of the third section 342-1 and the fourth section 342-2 increase by the rotation angle of the first board 211, respectively. Thus, the phase of the signal passing through the third section 342-1 and the fourth section 342-2 and transmitted to the output port P4 increases by a first phase (α°). The increased first phase (α°) may be the sum of the phase increments by the third section 342-1 and the fourth section 342-2, respectively. As a result, the phase of the signal transmitted to the output port P4 after the rotation of the first board 211 varies by α°+β°, compared to that before the rotation of the first board 211.

On the other hand, as the first board 211 rotates, the length of the second section 341-2 decreases by the rotation angle of the first board 211. Thus, the phase of the signal passing through the second section 341-2 and directed to the output ports P1 and P3 decreases by a second phase (P).

As the first board 211 rotates, the length of the output rail 302 does not vary, so that the phase of the signal transmitted to the output port P1 after the rotation of the first board 211 varies by −β°, compared to that before the rotation of the first board 211.

In addition, as the first board 211 rotates, the lengths of the fifth section 343-1 and the sixth section 343-2 decrease by the rotation angle of the first board 211, respectively. Thus, the phase of the signal passing through the fifth section 343-1 and the sixth section 343-2 and transmitted to the output port P3 decreases by a first phase (α°) The decreased first phase (α°) may be the sum of the phase decrements by the fifth section 343-1 and the sixth section 343-2, respectively. As a result, the phase of the signal transmitted to the output port P3 after the rotation of the first board 211 varies by −α°−β°, compared to that before the rotation of the first board 211.

In such a case, it can be seen that the phase change amount (−β°) of the signal transmitted to the output port P1 and the phase change amount (+β°) of the signal transmitted to the output port P2, according to the rotation of the first board 211, have a symmetrical relationship with each other. In addition, it can be seen that the phase change amount (−α°−β°) of the signal transmitted to the output port P3 and the phase change amount (+α°+β°) of the signal transmitted to the output port P4, according to the rotation of the first board 211, have a symmetrical relationship with each other.

When changing the phases of the signals transmitted to the respective output ports according to the rotation of the first board 211, the first section 341-1 may be used to adjust, as well as the phase of the signal transmitted to the output port P2, the phase of the signal transmitted to the output port P4 by the same second phase (β°). That is, since a connection rail for adjusting the phase of the signal transmitted to the output port P2 by the second phase (β°) and a connection rail for adjusting the phase of the signal transmitted to the output port P4 by the second phase (β°) are not separately required, the size of the phase shifter 120 can be reduced.

In such a case, the length of the second section 341-2 decreases in response to an increase in the length of the first section 341-1 according to the rotation of the first board 211. That is, the phase of the signal heading for the output ports P1 and P3 reversely varies in response to a change in the phase of the signal heading for the output ports P2 and P4 by the connection rail 311.

As described above, when the first board 211 and the second board 212 have a rail structure as shown in FIGS. 3A and 3B, the phase change amount of a signal transmitted to each output port according to the rotation of the first board 211 may be determined as shown in Table 1 below.

TABLE 1

| | Phases | |
|---|---|---|
| Output ports | Reference | Amount of change |
| P1 | 0° | −β° |
| P2 | 0° | +β° |
| P3 | 0° | −α° − β° |
| P4 | 0° | +α° + β° |

FIGS. 4A to 4D illustrate phase graphs for respective output ports according to a first embodiment of the present disclosure. FIGS. 4A to 4D illustrate phase graphs for respective output ports in the case where the first board 211 and the second board 212 have a rail structure as shown in FIGS. 3A to 3C. Here, the x-axis of the phase graph represents a frequency in GHz of a signal transmitted to each output port, and the y-axis represents a phase of a signal transmitted to each output port.

Figure 4A:
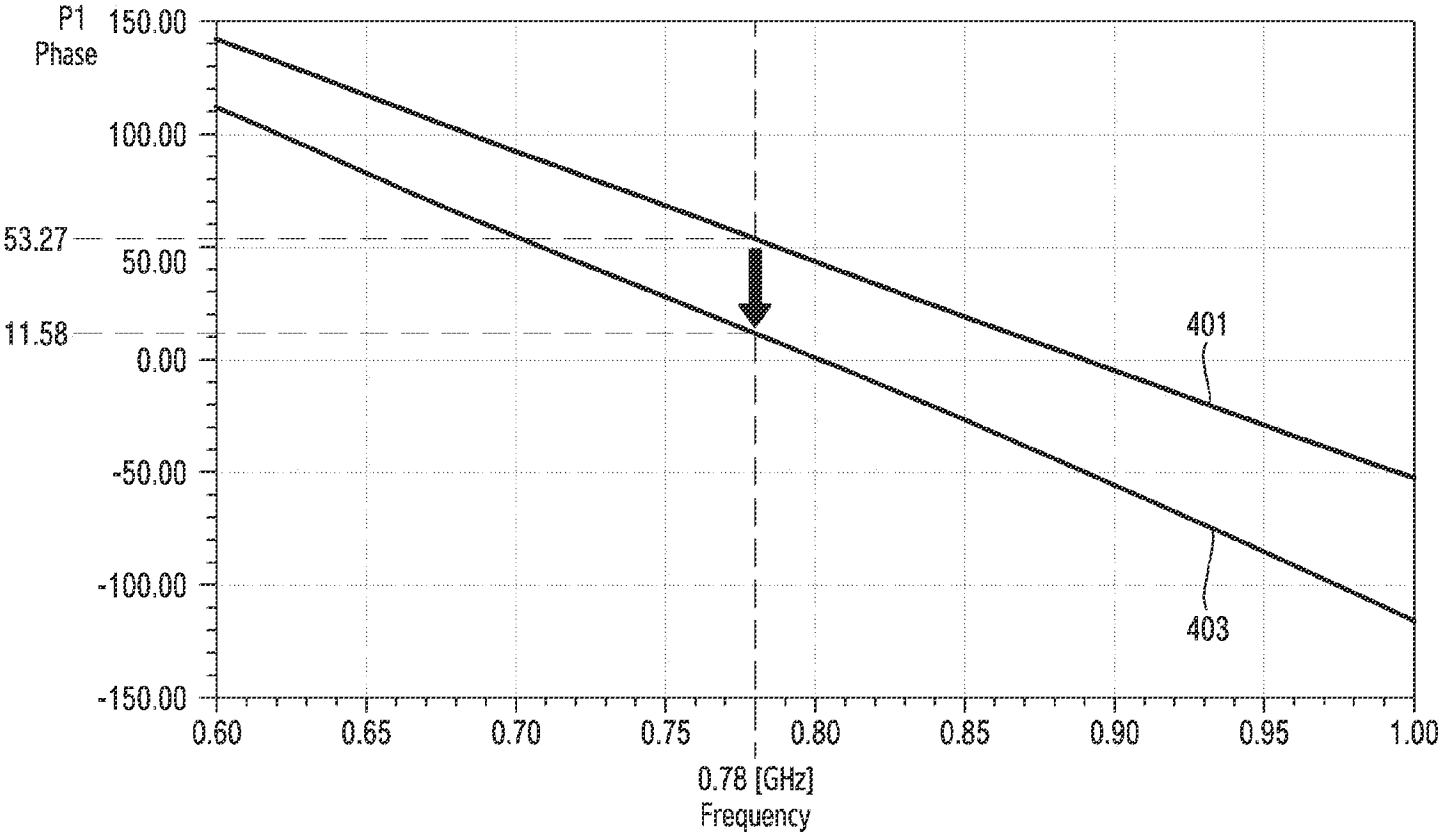
FIGS. 4A to 4D illustrate phase graphs for respective output ports according to a first embodiment of the present disclosure.

Referring to FIG. 4A, a straight line 401 represents a phase of the signal transmitted to the output port P1 corresponding to each frequency before the first board 211 rotates. A straight line 403 represents a phase of the signal transmitted to the output port P1 corresponding to each frequency after the first board 211 rotates. For example, in the case where the frequency of a signal transmitted to the output port P1 is 0.78 GHz, if the phase of the signal transmitted to the output port P1 before the rotation of the first board 211 is +53.27°, the phase of the signal transmitted to the output port P1 after the rotation of the first board 211 may be +11.58°. That is, the phase change amount of the signal transmitted to the output port P1, which is generated due to the rotation of the first board 211, may be about −42°. In some embodiments, when the first board 211 and the second board 212 have a rail structure as shown in FIGS. 3A to 3C, the phase change amount (−β°) of the signal transmitted to the output port P1 may be −42'.

Figure 4B:
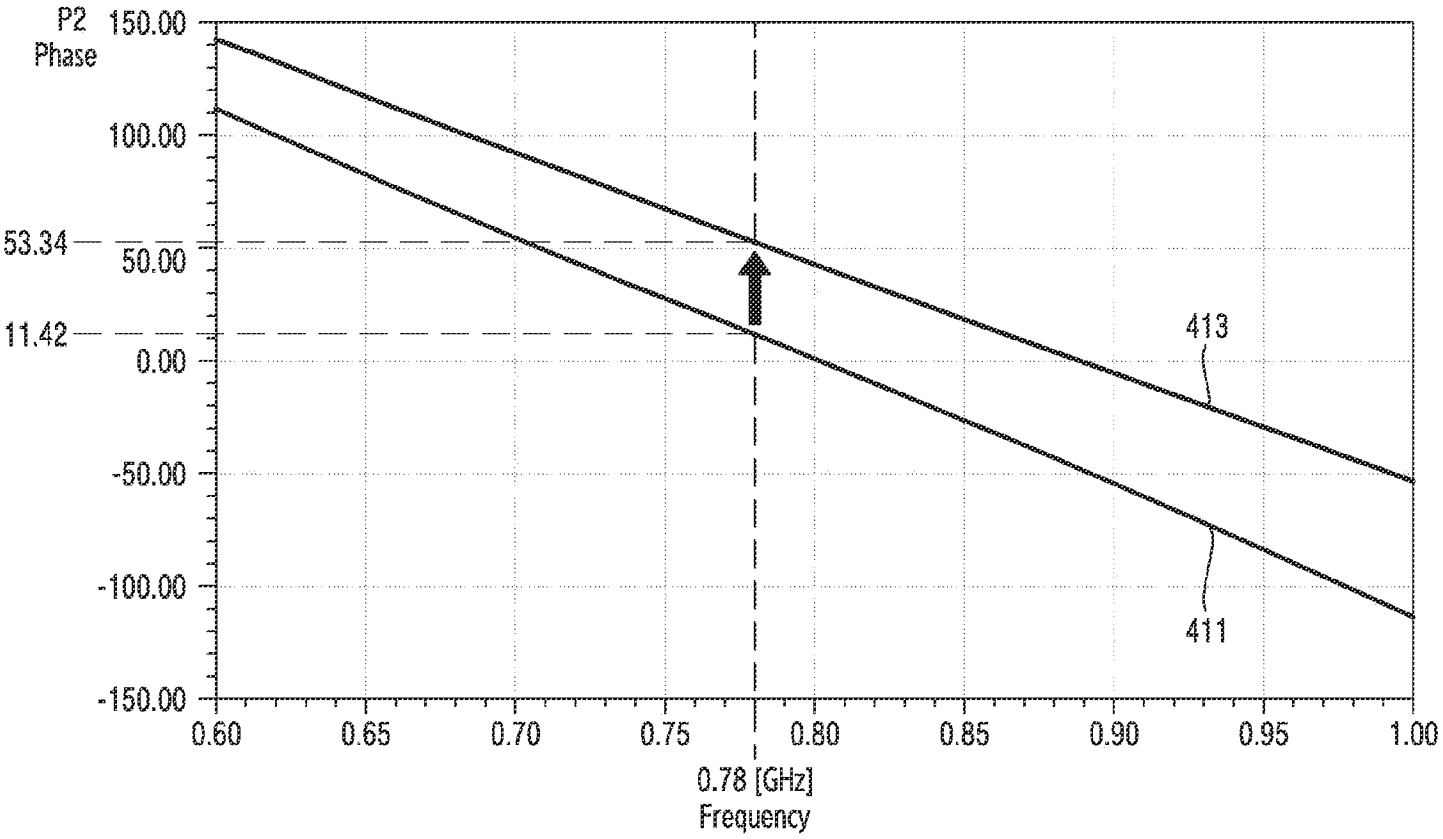

Referring to FIG. 4B, a straight line 411 represents a phase of a signal transmitted to the output port P2 corresponding to each frequency before the first board 211 rotates. A straight line 413 represents a phase of a signal transmitted to the output port P2 corresponding to each frequency after the first board 211 rotates. For example, in the case where the frequency of the signal transmitted to the output port P2 is 0.78 GHz, if the phase of the signal transmitted to the output port P2 before the rotation of the first board 211 is +11.42°, the phase of the signal transmitted to the output port P2 after the rotation of the first board 211 may be +53.34°. That is, the phase change amount of the signal transmitted to the output port P2, which is generated due to the rotation of the first board 211, may be about +42°. In some embodiments, when the first board 211 and the second board 212 have a rail structure as shown in FIGS. 3A to 3C, the phase change amount (+β°) of the signal transmitted to the output port P2 may be +42°.

Figure 4C:
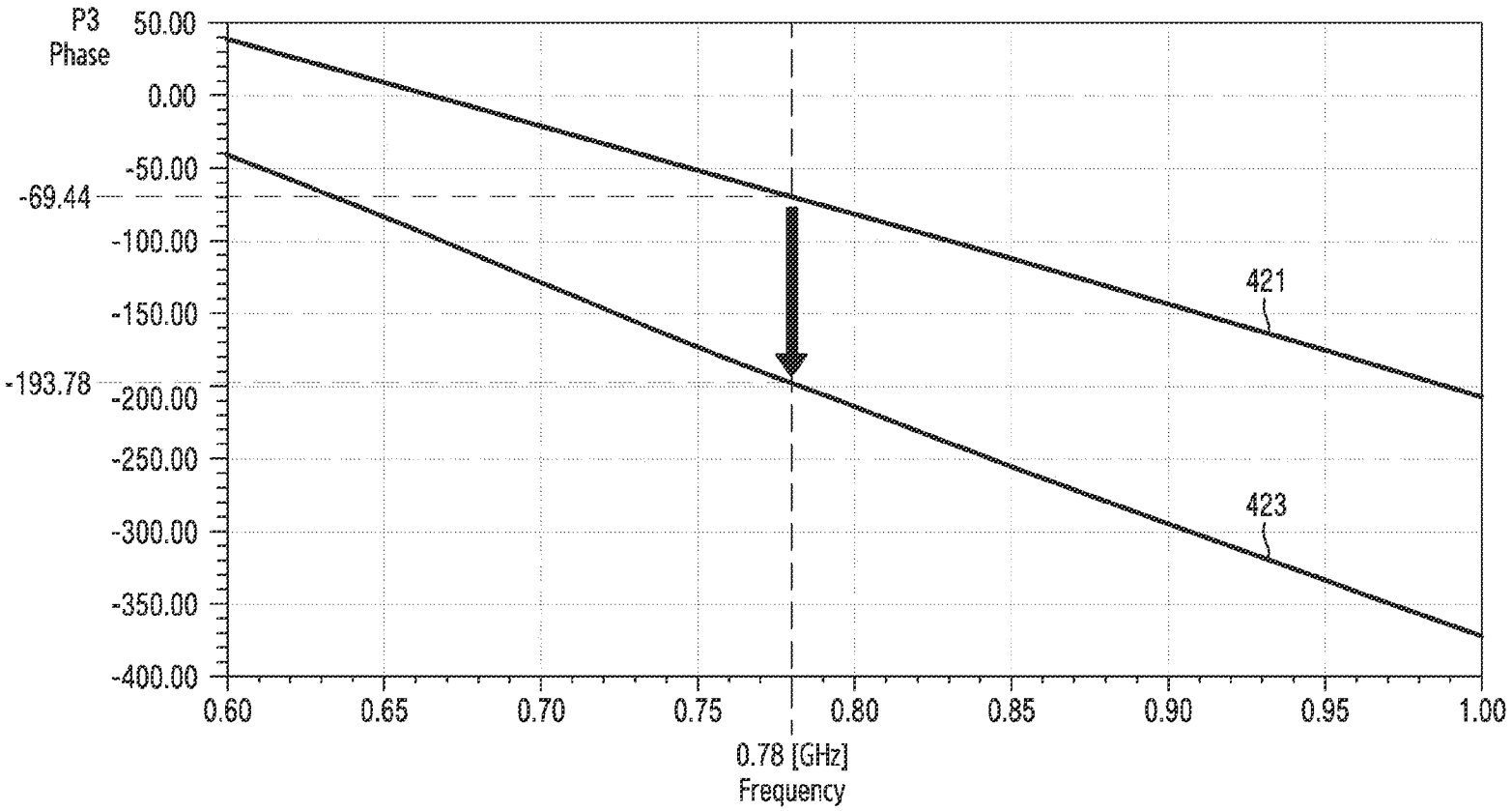

Referring to FIG. 4C, a straight line 421 represents a phase of a signal transmitted to the output port P3 corresponding to each frequency before the first board 211 rotates. A straight line 423 represents a phase of a signal transmitted to the output port P3 corresponding to each frequency after the first board 211 rotates. For example, in the case where the frequency of the signal transmitted to the output port P3 is 0.78 GHz, if the phase of the signal transmitted to the output port P3 before the rotation of the first board 211 is −69.44°, the phase of the signal transmitted to the output port P3 after the rotation of the first board 211 may be −193.78°. That is, the phase change amount of the signal transmitted to the output port P3, which is generated due to the rotation of the first board 211, may be about −124°. In some embodiments, when the first board 211 and the second board 212 have a rail structure as shown in FIGS. 3A to 3C, the phase change amount (−α°−β°) of the signal transmitted to the output port P3 may be −124°.

Figure 4D:
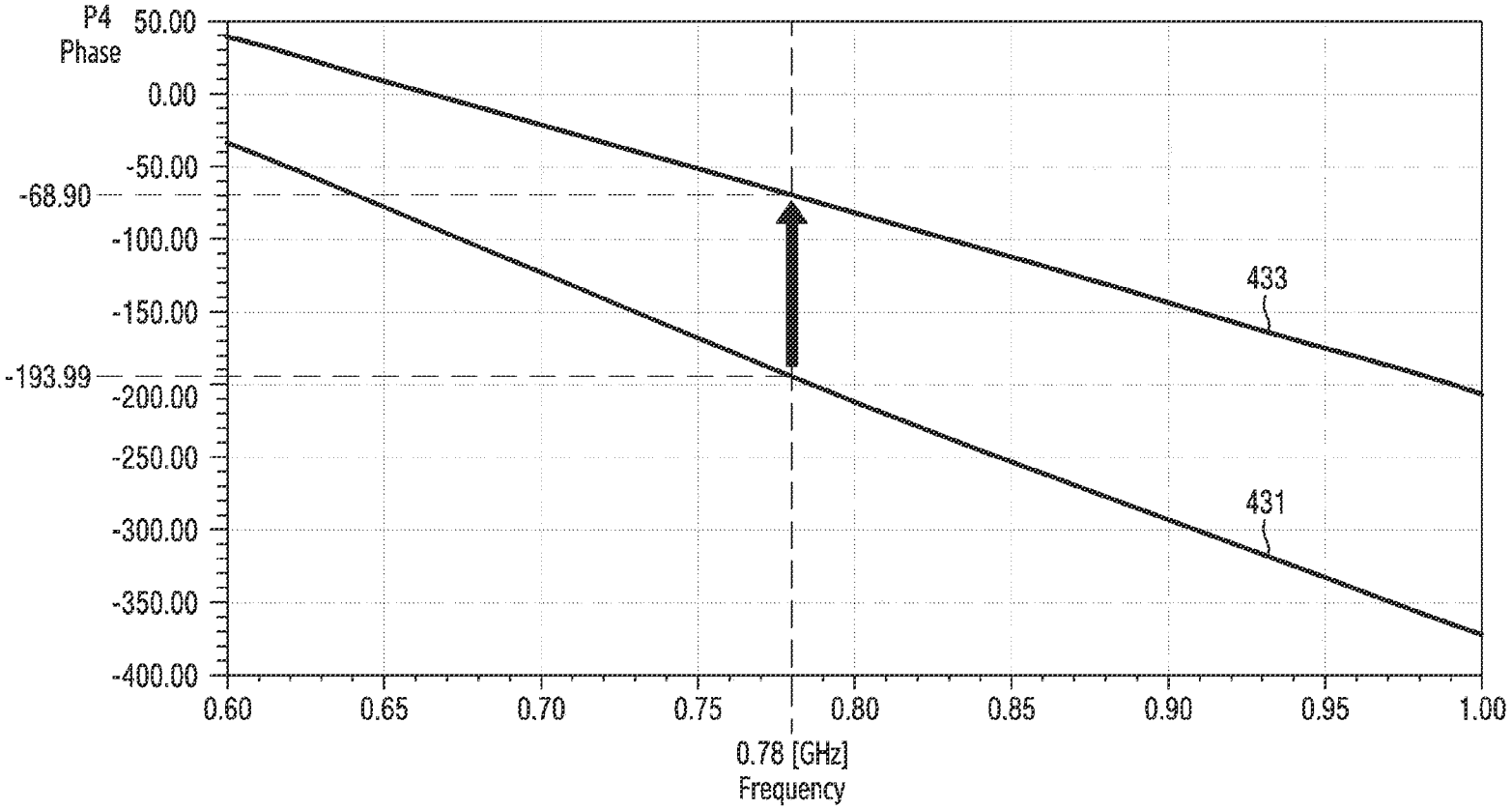

Referring to FIG. 4D, a straight line 431 represents a phase of a signal transmitted to the output port P4 corresponding to each frequency before the first board 211 rotates. A straight line 433 represents a phase of a signal transmitted to the output port P4 corresponding to each frequency after the first board 211 rotates. For example, in the case where the frequency of the signal transmitted to the output port P4 is 0.78 GHz, if the phase of the signal transmitted to output port P4 before the rotation of the first board 211 is −193.99°, the phase of the signal transmitted to the output port P4 after the rotation of the first board 211 may be −68.90°. That is, the phase change amount of the signal transmitted to the output port P4, which is generated due to the rotation of the first board 211, may be about +124°. In some embodiments, when the first board 211 and the second board 212 have a rail structure as shown in FIGS. 3A to 3C, the phase change amount (+α°−β°) of the signal transmitted to the output port P4 may be +124°.

Figure 5A:
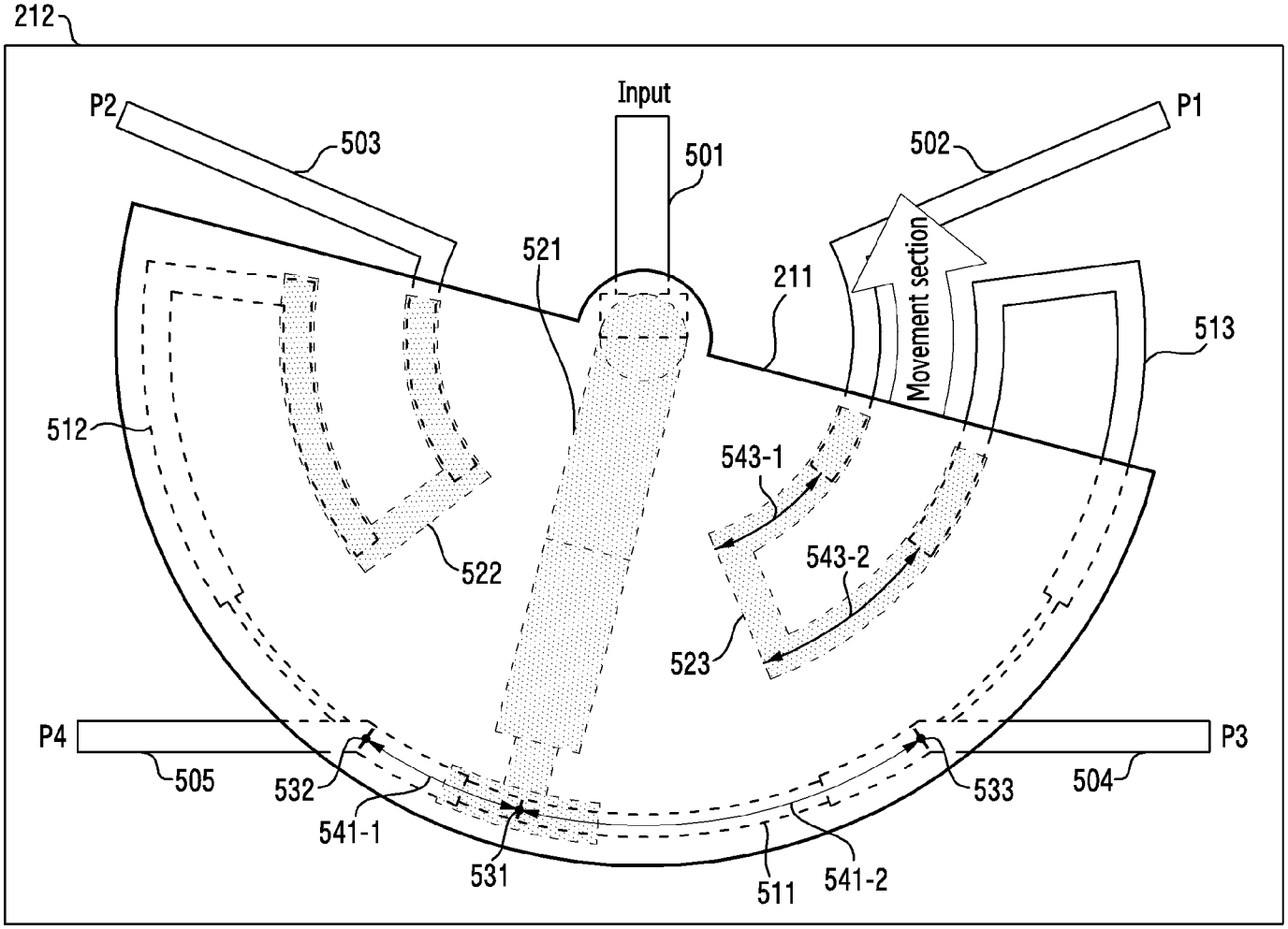
FIGS. 5A to 5C illustrate front views of a phase changer before and after rotation of a first board according to a second embodiment of the present disclosure.
Figure 5B:
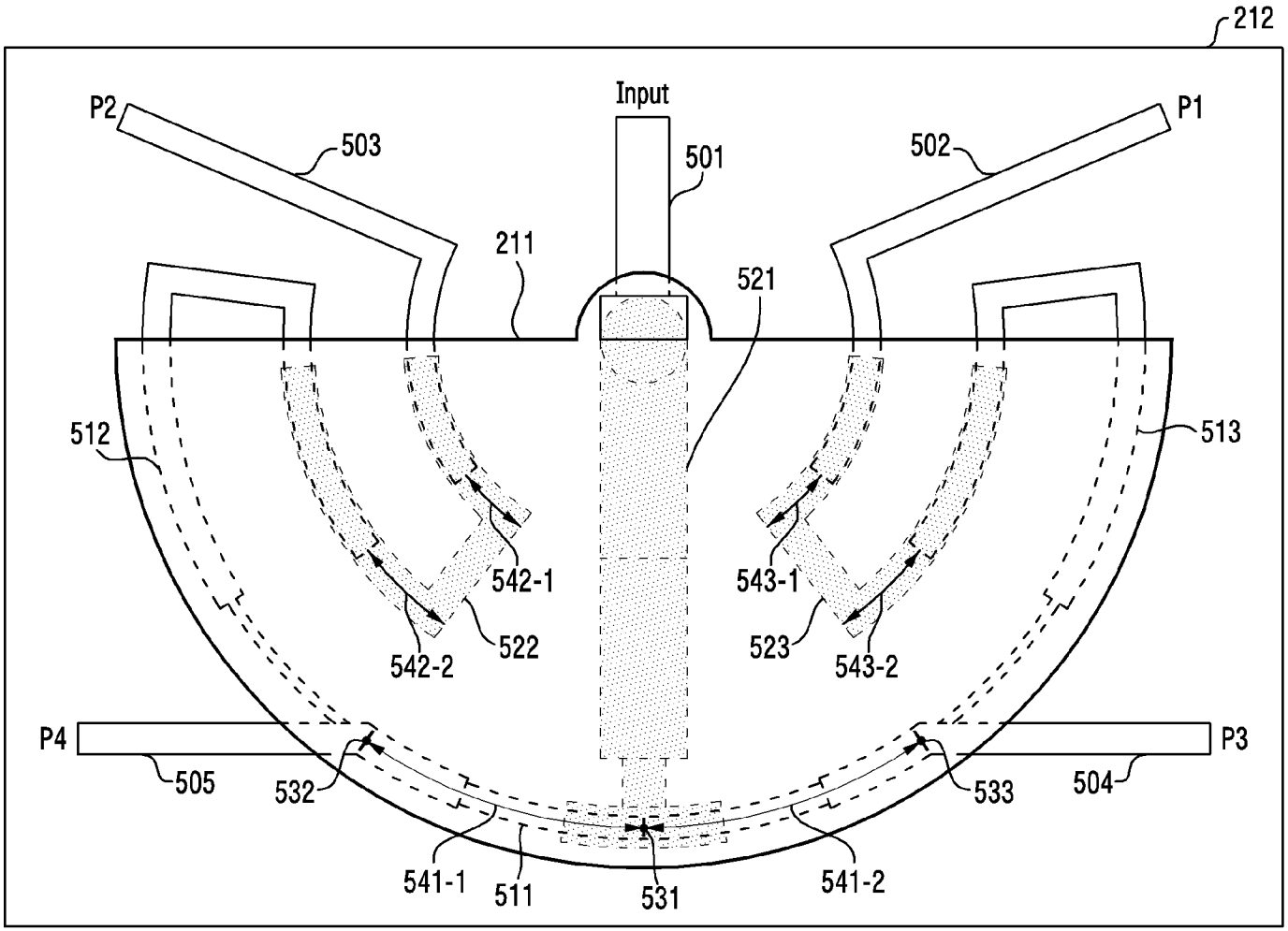
Figure 5C:
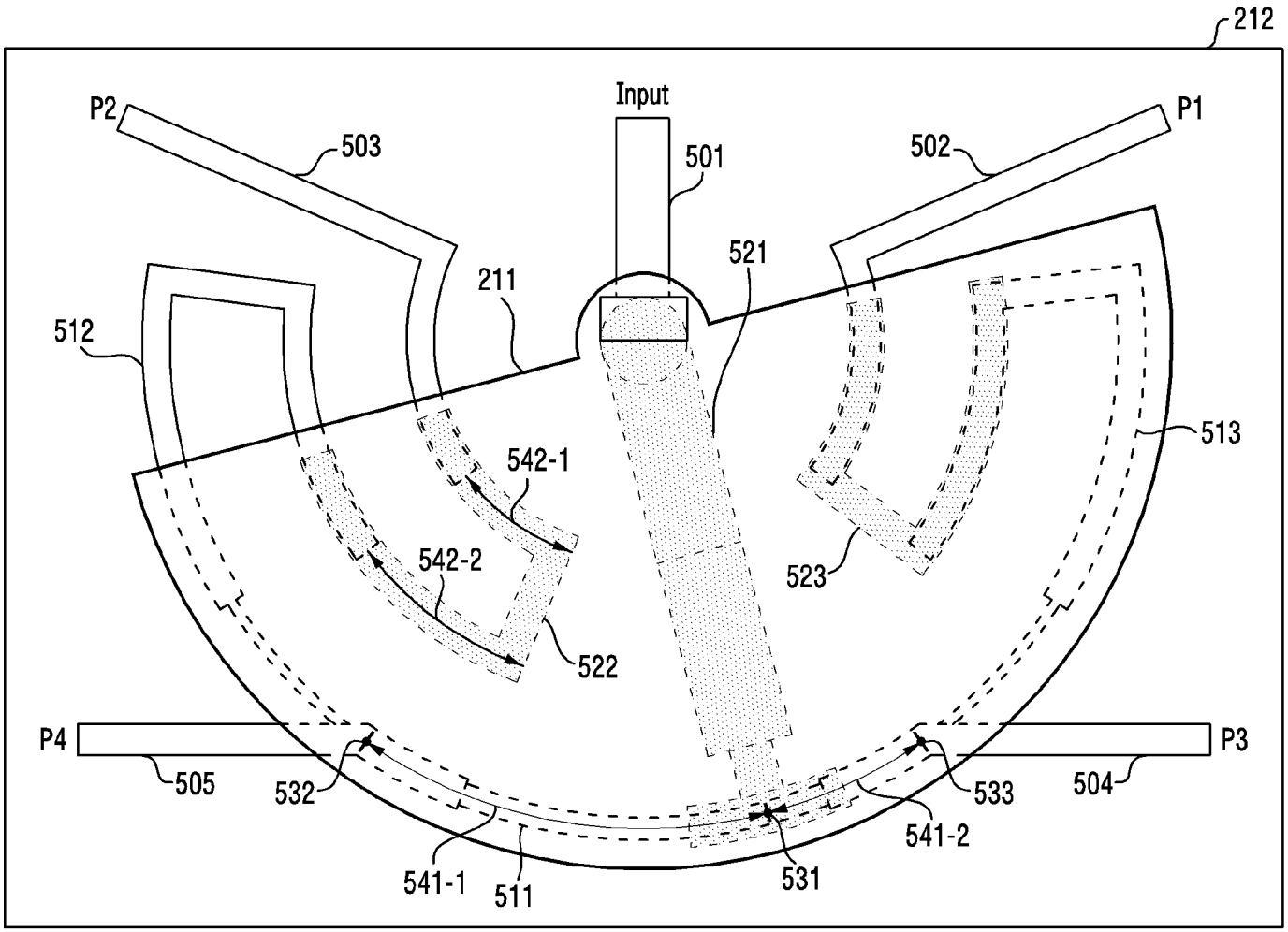

FIGS. 5A to 5C illustrate front views of a phase changer before and after rotation of a first board according to a second embodiment of the present disclosure.

Referring to FIGS. 5A to 5C, the first board 211 includes a phase changing rail 521, a phase changing rail 522, and a phase changing rail 523. The second board 212 includes an input rail 501 connected to an input port, an output rail 502 connected to an output port P1, an output rail 503 connected to an output port P2, an output rail 504 connected to an output port P3, an output rail 505 connected to an output port P4, and connection rails 511, 512, and 513. The connection rail 511 may connect the output rail 504 and the output rail 505. The connection rail 512 may be connected to the point where the connection rail 511 and the output rail 505 are connected. The connection rail 513 may be connected to the point where the connection rail 511 and the output rail 504 are connected. The respective thicknesses of the various rails included in FIGS. 5A to 5C may be designed to be different from each other in order to match impedance between neighboring rails. In this case, since the connection rail 511 does not include a comb-pattern rail, the size of the phase shifter may be reduced. In addition, since the connection rail 511 does not include a comb-pattern rail, the phase shifter can more precisely control the phase change amount of the signal transmitted to each output port.

A signal transmitted from the input port and passing through the input rail 501 is divided at a first division point 531 into a signal directed to the output ports P1 and P3 and a signal directed to the output ports P2 and P4. The first division point 531 may refer to the center of the portion where the phase changing rail 521 and the connection rail 511 are coupled to each other.

Thereafter, the signal that has passed through a first section 541-1 of the connection rail 511 and directed to the output ports P2 and P4 is divided again at a second division point 532 into a signal transmitted to the output port P2 and a signal transmitted to the output port P4. The second division point 532 may refer to a point where the connection rail 511, the connection rail 512, and the output rail 505 are connected to each other. In addition, the signal that has passed a second section 541-2 of the connection rail 511 and directed to the output ports P1 and P3 is divided again at a third division point 533 into a signal transmitted to the output port P1 and a signal transmitted to the output port P3. The third division point 533 may refer to a point where the connection rail 511, the connection rail 513, and the output rail 504 are connected to each other. In addition, the first section 541-1 may refer to the portion that ranges from the first division point 531 to the second division point 532 in the connection rail 511. The second section 541-2 may refer to the portion that ranges from the first division point 531 to the third division point 533 in the connection rail 511.

The signal transmitted to the output port P2 passes through a third section 542-1 in FIGS. 5B and 5C and a fourth section 542-2 in FIGS. 5B and 5C of the connection rail 512, and the signal transmitted to the output port P4 passes through the output rail 505. The third section 342-1 may refer to a portion where the coupling with the output rail 503 is released in the phase changing rail 522 as the first board 211 rotates. The fourth section 542-2 may refer to a portion where the coupling with the connection rail 513 is released in the phase changing rail 523 as the first board 211 rotates.

In some embodiments, when the first board 211 rotates as indicated by the arrow designated as "Movement Section", the third section 542-1 and the fourth section 542-2 may be different from each other in the amount of change in the length thereof because the arc length of the first board 211 varies depending on the radius thereof during the rotation of the first board 211. Thus, as the first board 211 rotates, the phase change amounts of the signals passing through the third section 542-1 and the fourth section 542-2 may be different from each other. In some embodiments, since the length of the phase changing rail 521 is greater than that of the phase changing rail 321 shown in FIG. 3B, the amount of change in the length of the first section 541-1 in FIG. 5B may be greater than the amount of change in the length of the first section 341-1 in FIG. 3B according to the rotation of the first board 211. Thus, although the connection rail 511 does not have a comb-line shape, the phase change amount of the signal passing through the first section 541-1 in FIG. 5B according to the rotation of the first board 211 may be greater than that of the signal passing through the first section 341-1 in FIG. 3B.

The signal transmitted to the output port P1 passes through a fifth section 543-1 in FIG. 5A and FIG. 5B and a sixth section 543-2 in FIG. 5A and FIG. 5B in the connection rail 513, and the signal transmitted to the output port P3 passes through the output rail 504. The fifth section 543-1 may refer to a candidate portion that may be further coupled to the output rail 502 in the phase changing rail 523 when the first board 211 rotates. The sixth section 543-2 may refer to a candidate portion that may be further coupled to the connection rail 513 in the phase changing rail 523 when the first board 211 rotates.

In such a case, as the first board 211 rotates, the length of the first section 541-1 increases by the rotation angle of the first board 211. Accordingly, the phase of the signal passing through the first section 541-1 and heading for the output ports P2 and P4 increases by a first phase (α°).

As the first board 211 rotates, the lengths of the third section 542-1 and the fourth section 542-2 increase by the rotation angle of the first board 211, respectively. Thus, the phase of the signal passing through the third section 542-1 and the fourth section 542-2 and transmitted to the output port P2 increases by a second phase (β+). The increased second phase (β°) may be the sum of the phase increments by the third section 542-1 and the fourth section 542-2, respectively. As a result, the phase of the signal transmitted to the output port P2 after the rotation of the first board 211 varies by +α°+β°, compared to that before the rotation of the first board 211.

In addition, as the first board 211 rotates, the length of the output rail 505 does not vary, so that the phase of the signal transmitted to the output port P4 after the rotation of the first board 211 varies by +a compared to that before the rotation of the first board 211.

On the other hand, as the first board 211 rotates, the length of the second section 541-2 decreases by the rotation angle of the first board 211. Thus, the phase of the signal passing through the second section 541-2 and heading for the output ports P1 and P3 decreases by a first phase (α°).

As the first board 211 rotates, the lengths of the fifth section 543-1 and the sixth section 543-2 decrease by the rotation angle of the first board 211, respectively. Thus, the phase of the signal passing through the fifth section 543-1 and the sixth section 543-2 and transmitted to the output port P1 decreases by a second phase (β°) The decreased second phase (β°) may be the sum of the phase decrements by the fifth section 543-1 and the sixth section 543-2, respectively. As a result, the phase of the signal transmitted to the output port P1 after the rotation of the first board 211 varies by −α°−β°, compared to that before the rotation of the first board 211.

In addition, as the first board 211 rotates, the length of the output rail 504 does not vary, so that the phase of the signal transmitted to the output port P3 after the rotation of the first board 211 varies by −α°, compared to that before the rotation of the first board 211.

In such a case, it can be seen that the phase change amount (−α°−β°) of the signal transmitted to the output port P1 and the phase change amount (+α°+β°) of the signal transmitted to the output port P2, according to the rotation of the first board 211, have a symmetrical relationship with each other. In addition, it can be seen that the phase change amount (−α°) of the signal transmitted to the output port P3 and the phase change amount (+α°) of the signal transmitted to the output port P4, according to the rotation of the first board 211, have a symmetrical relationship with each other.

When changing the phases of the signals transmitted to the respective output ports according to the rotation of the first board 211, the first section 541-1 may be used to adjust the phase of the signal transmitted to the output port P2 and to adjust the phase of the signal transmitted to the output port P4 by the same first phase (α°). That is, since a connection rail for adjusting the phase of the signal transmitted to the output port P2 by the first phase (α°) and a connection rail for adjusting the phase of the signal transmitted to the output port P4 by the first phase (α°) are not separately required, the size of the phase shifter 120 can be reduced.

In such a case, the length of the second section 541-2 decreases in response to an increase in the length of the first section 541-1 according to the rotation of the first board 211. That is, the phase of the signal heading for the output ports P1 and P3 reversely varies in response to a change in the phase of the signal heading for the output ports P2 and P4 by the connection rail 511.

As described above, when the first board 211 and the second board 212 have a rail structure as shown in FIGS. 5A and 5C, the phase change amount of a signal transmitted to each output port according to the rotation of the first board 211 may be determined as shown in Table 2 below.

TABLE 2

| | Phases | |
|---|---|---|
| Output ports | Reference | Amount of change |
| P1 | 0° | −α° − β° |
| P2 | 0° | +α° + β° |
| P3 | 0° | −α° |
| P4 | 0° | +α° |

FIGS. 6A to 6D illustrate phase graphs for respective output ports according to a second embodiment of the present disclosure. FIGS. 6A to 6D illustrate phase graphs for respective output ports in the case where the first board 211 and the second board 212 have a rail structure as shown in FIGS. 5A to 5C. Here, the x-axis of the phase graph represents a frequency in GHz of a signal transmitted to each output port, and the y-axis represents a phase of a signal transmitted to each output port.

Figure 6A:
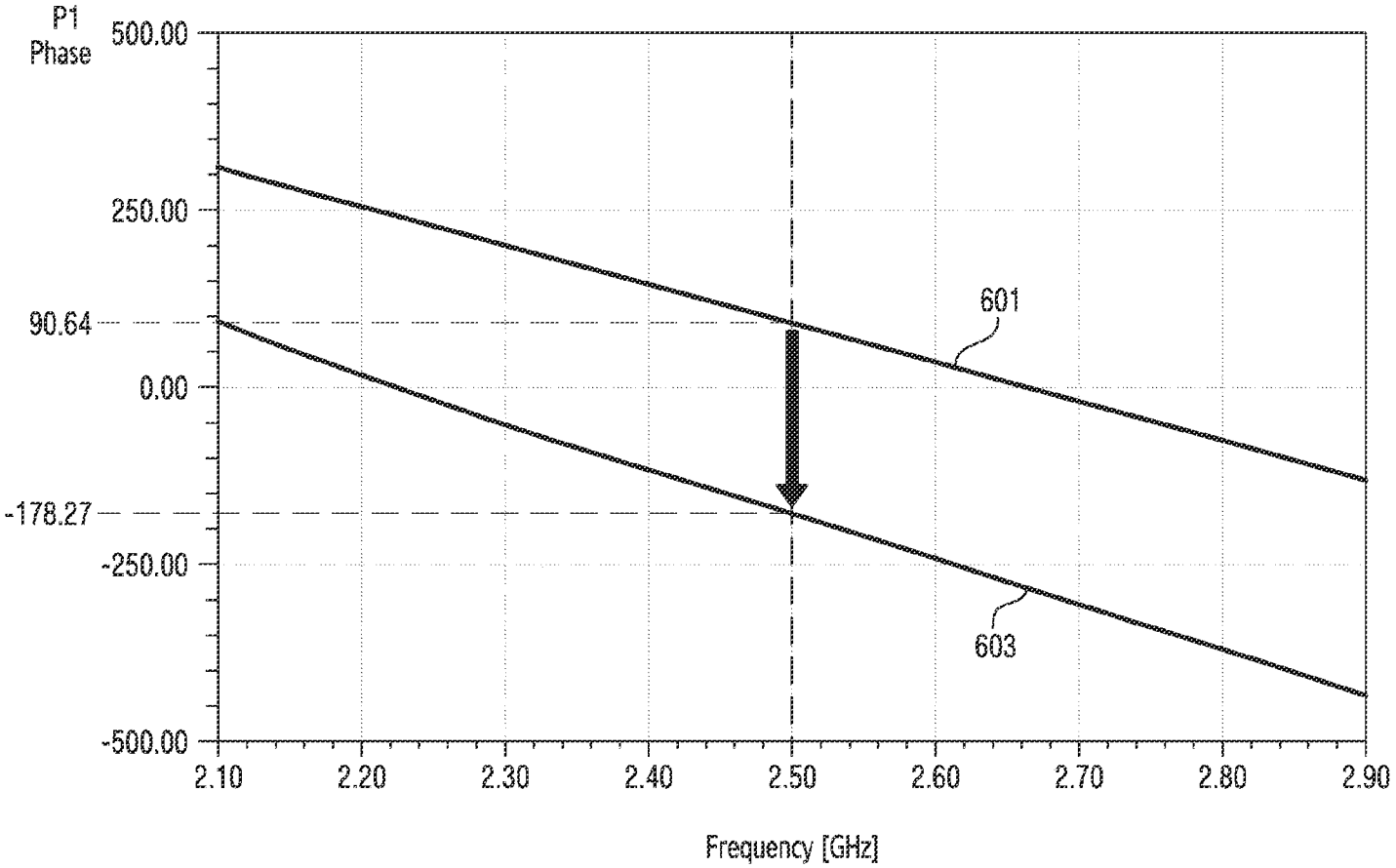
FIGS. 6A to 6D illustrate phase graphs for respective output ports according to a second embodiment of the present disclosure.

Referring to FIG. 6A, a straight line 601 represents a phase of the signal transmitted to the output port P1 corresponding to each frequency before the first board 211 rotates. A straight line 603 represents a phase of the signal transmitted to the output port P1 corresponding to each frequency after the first board 211 rotates. For example, in the case where the frequency of a signal transmitted to the output port P1 is 2.50 GHz, if the phase of the signal transmitted to the output port P1 before the rotation of the first board 211 is +90.64°, the phase of the signal transmitted to the output port P1 after the rotation of the first board 211 may be −178.27°. That is, the phase change amount of the signal transmitted to the output port P1, which is generated due to the rotation of the first board 211, may be about −269°. In some embodiments, when the first board 211 and the second board 212 have a rail structure as shown in FIGS. 5A to 5C, the phase change amount (−α°−β°) of the signal transmitted to the output port P1 may be −269°.

Figure 6B:
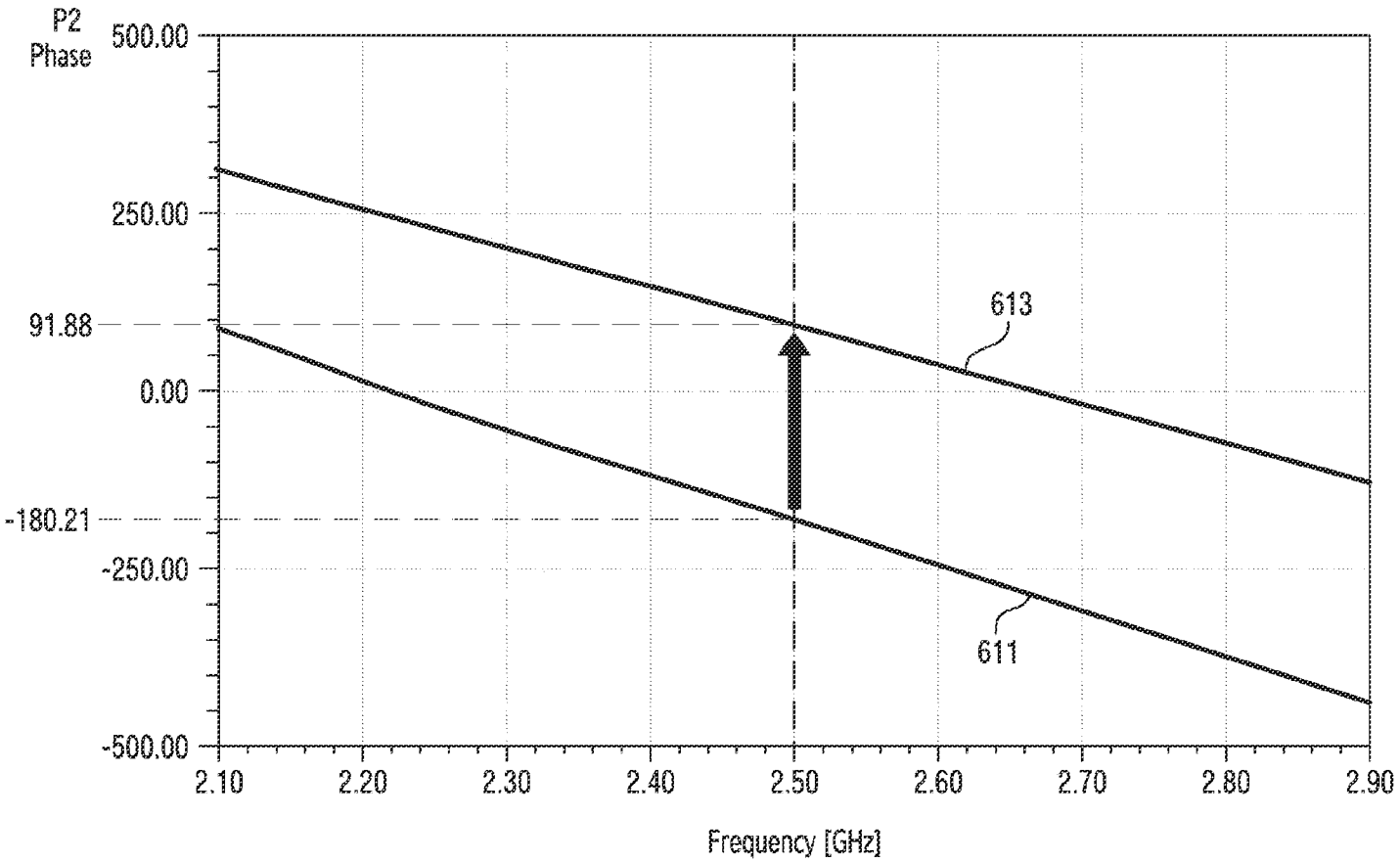

Referring to FIG. 6B, a straight line 611 represents a phase of a signal transmitted to the output port P2 corresponding to each frequency before the first board 211 rotates. A straight line 613 represents a phase of a signal transmitted to the output port P2 corresponding to each frequency after the first board 211 rotates. For example, in the case where the frequency of the signal transmitted to the output port P2 is 2.50 GHz, if the phase of the signal transmitted to the output port P2 before the rotation of the first board 211 is −180.21°, the phase of the signal transmitted to the output port P2 after the rotation of the first board 211 may be +91.88°. That is, the phase change amount of the signal transmitted to the output port P2, which is generated due to the rotation of the first board 211, may be about +272°. In some embodiments, when the first board 211 and the second board 212 have a rail structure as shown in FIGS. 5A to 5C, the phase change amount (+α°+β°) of the signal transmitted to the output port P2 may be +272'.

Figure 6C:
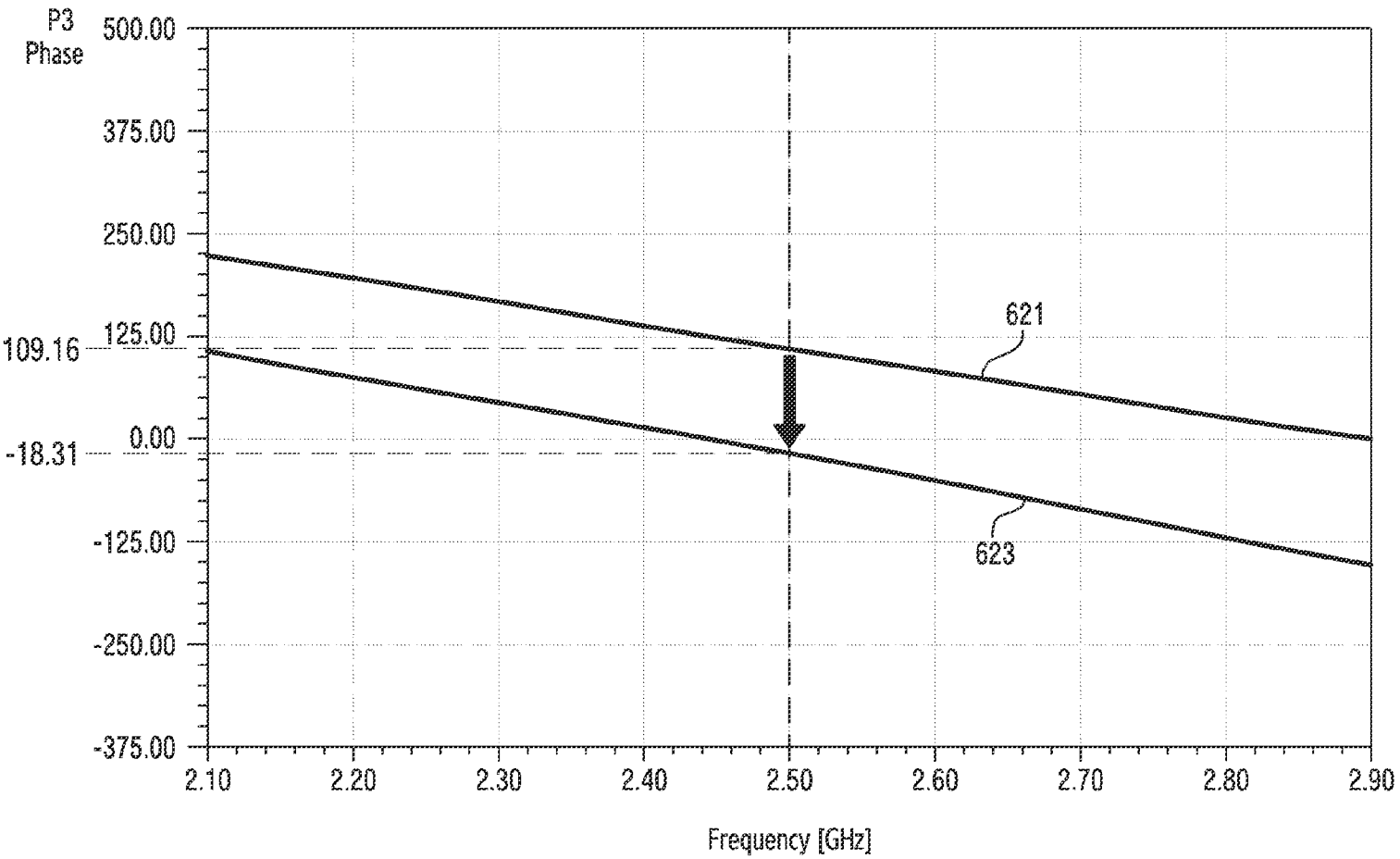

Referring to FIG. 6C, a straight line 621 represents a phase of a signal transmitted to the output port P3 corresponding to each frequency before the first board 211 rotates. A straight line 623 represents a phase of a signal transmitted to the output port P3 corresponding to each frequency after the first board 211 rotates. For example, in the case where the frequency of the signal transmitted to the output port P3 is 2.50 GHz, if the phase of the signal transmitted to the output port P3 before the rotation of the first board 211 is +109.16<, the phase of the signal transmitted to the output port P3 after the rotation of the first board 211 may be −18.31°. That is, the phase change amount of the signal transmitted to the output port P3, which is generated due to the rotation of the first board 211, may be about −127°. In some embodiments, when the first board 211 and the second board 212 have a rail structure as shown in FIGS. 5A to 5C, the phase change amount (−α°) of the signal transmitted to the output port P3 may be −127°.

Figure 6D:
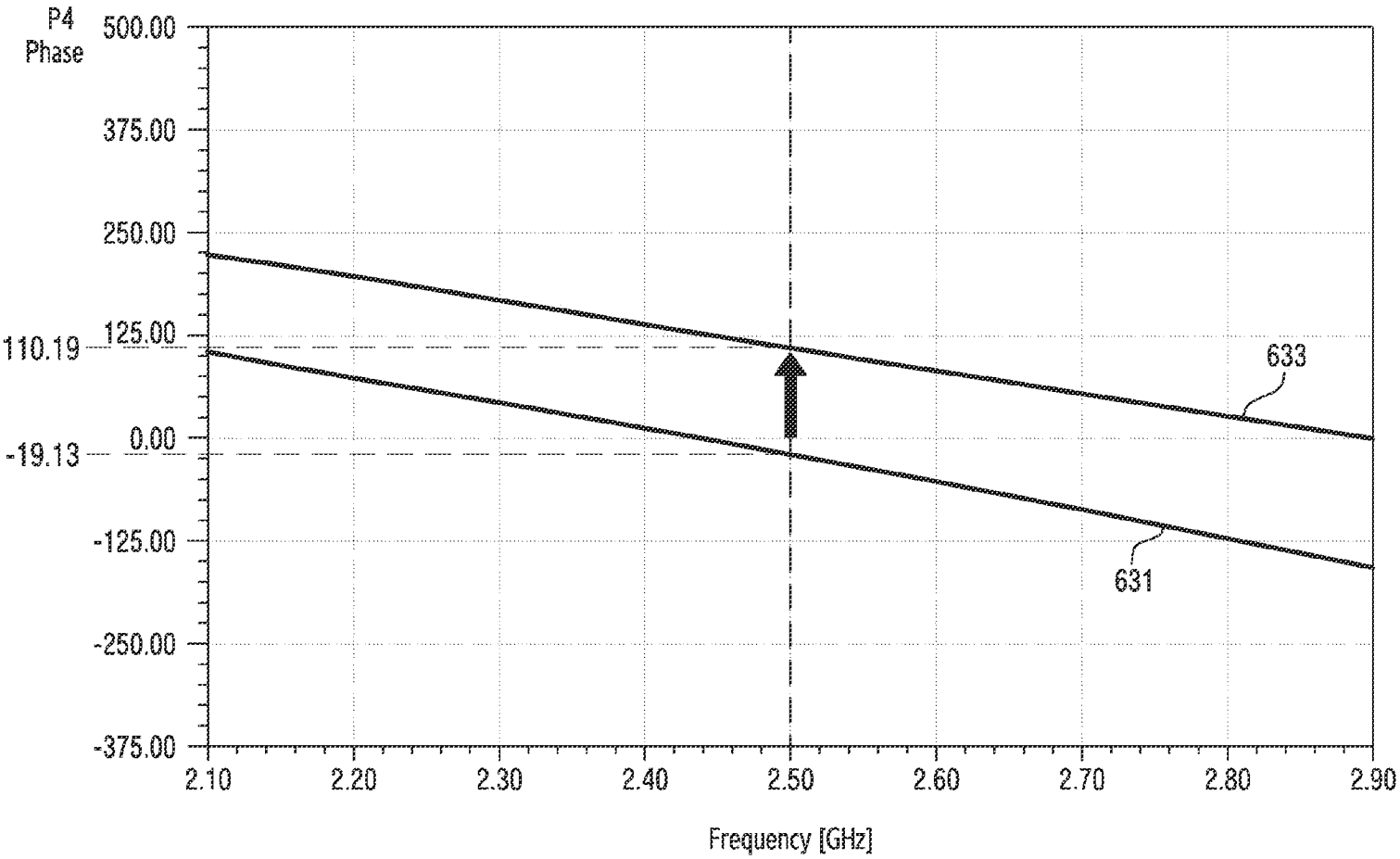

Referring to FIG. 6D, a straight line 631 represents a phase of a signal transmitted to the output port P4 corresponding to each frequency before the first board 211 rotates. A straight line 633 represents a phase of a signal transmitted to the output port P4 corresponding to each frequency after the first board 211 rotates. For example, in the case where the frequency of the signal transmitted to the output port P4 is 2.50 GHz, if the phase of the signal transmitted to output port P4 before the rotation of the first board 211 is −19.13°, the phase of the signal transmitted to the output port P4 after the rotation of the first board 211 may be −110.19°. That is, the phase change amount of the signal transmitted to the output port P4, which is generated due to the rotation of the first board 211, may be about +129°. In some embodiments, when the first board 211 and the second board 212 have a rail structure as shown in FIGS. 5A to 5C, the phase change amount (+α°) of the signal transmitted to the output port P4 may be +129°.

Figure 7A:
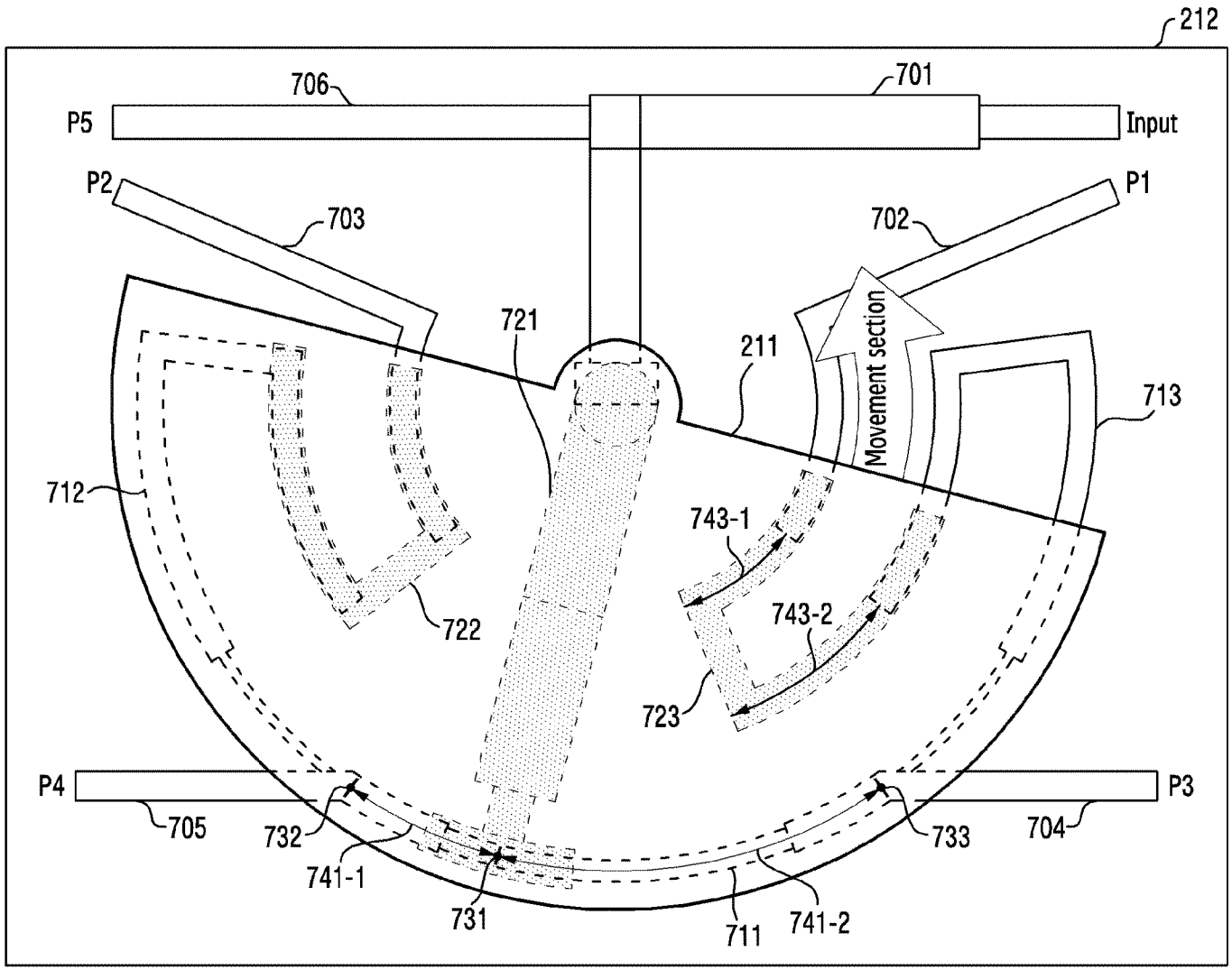
FIGS. 7A to 7C illustrate front views of a phase changer before and after rotation of a first board according to a third embodiment of the present disclosure.
Figure 7B:
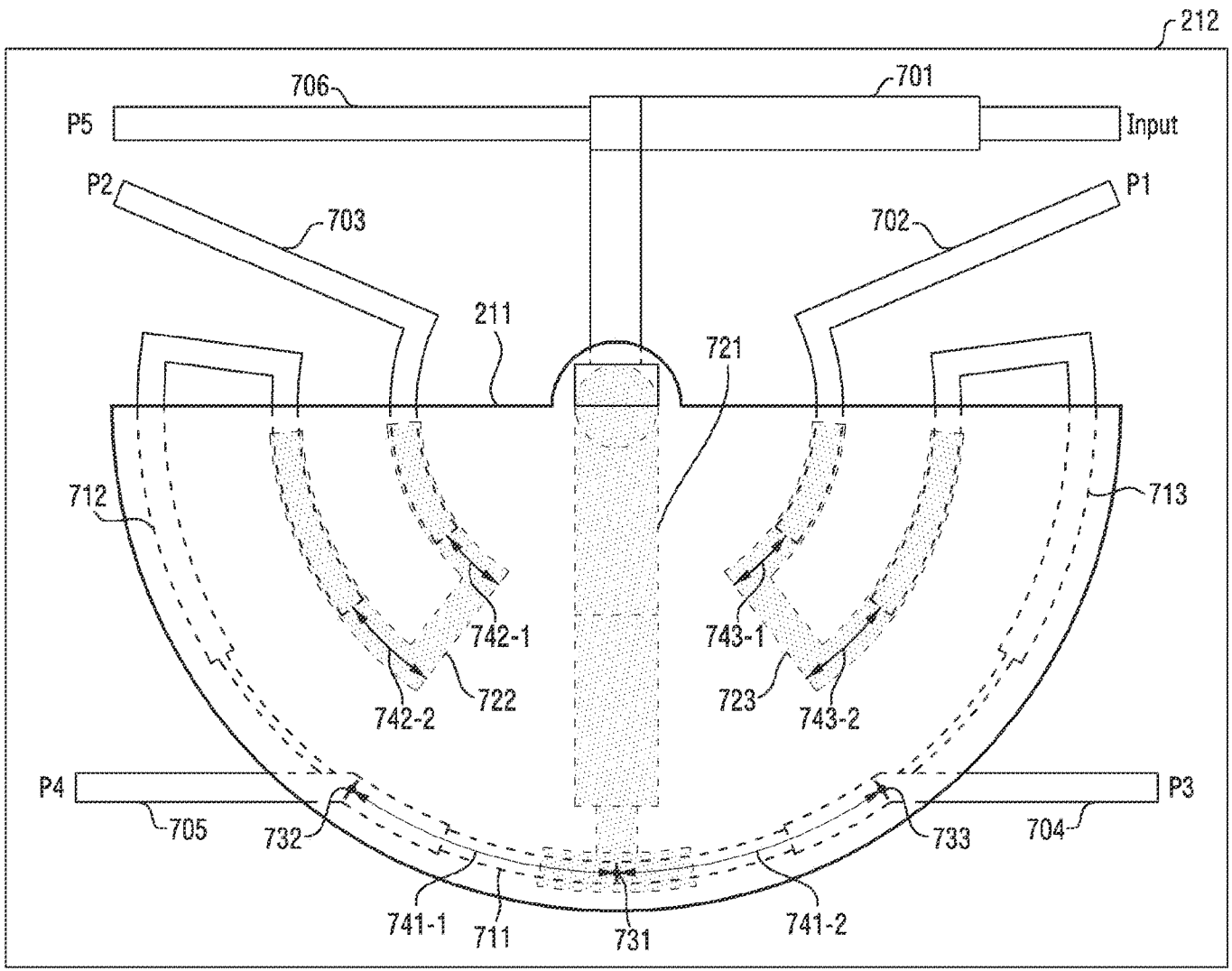
Figure 7C:
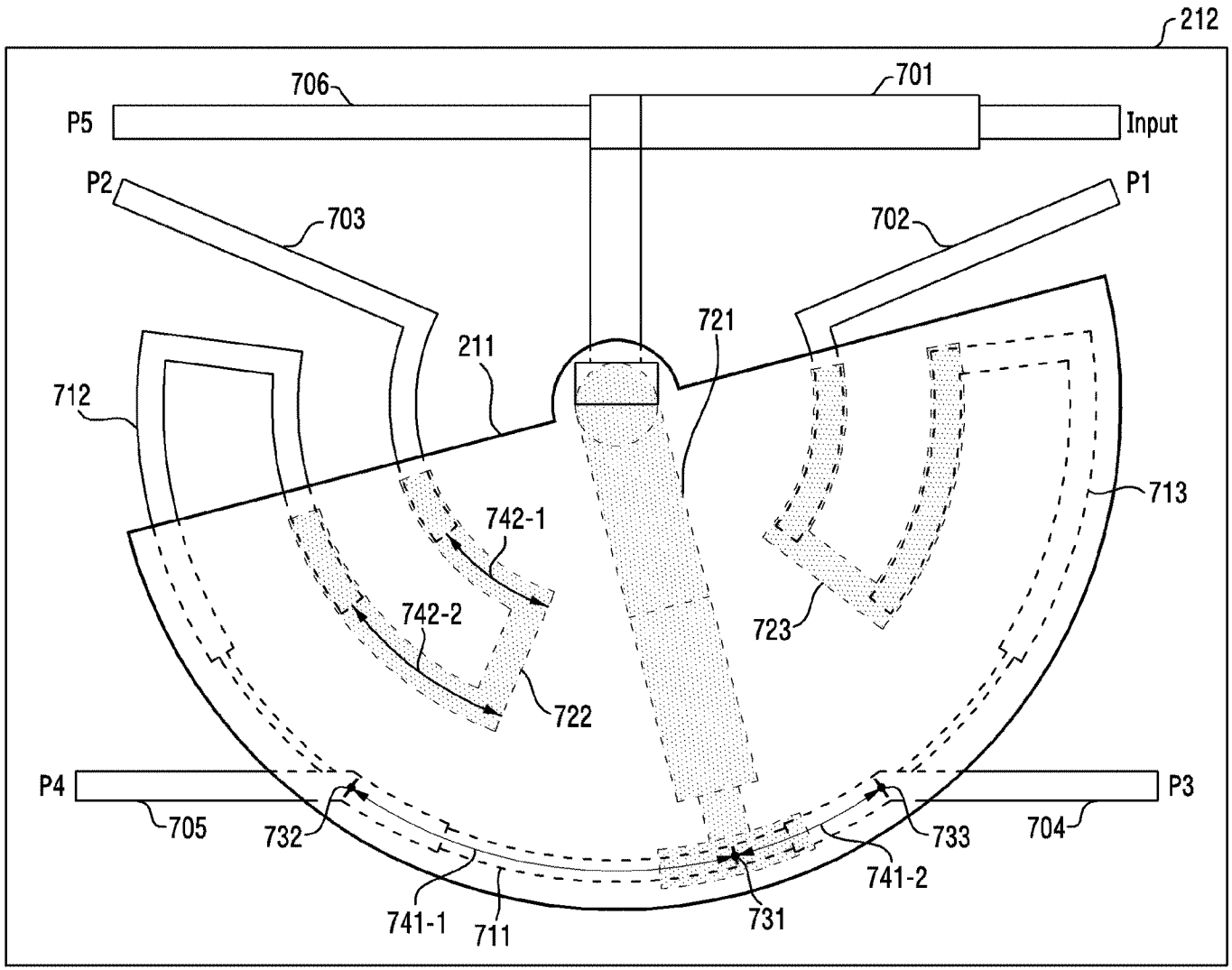

FIGS. 7A to 7C illustrate front views of a phase changer before and after rotation of a first board according to a third embodiment of the present disclosure.

Referring to FIGS. 7A to 7C, the first board 211 includes a phase changing rail 721, a phase changing rail 722, and a phase changing rail 723. The second board 212 includes an input rail 701 connected to an input port, an output rail 702 connected to an output port P1, an output rail 703 connected to an output port P2, an output rail 704 connected to an output port P3, an output rail 705 connected to an output port P4, an output rail 706 connected to an output port P5, and connection rails 711, 712, and 713. The connection rail 711 may connect the output rail 704 and the output rail 705. The connection rail 712 may be connected to the point where the connection rail 711 and the output rail 705 are connected. The connection rail 713 may be connected to the point where the connection rail 711 and the output rail 704 are connected. The respective thicknesses of the various rails included in FIGS. 7A to 7C may be designed to be different from each other in order to match impedance between neighboring rails.

A signal transmitted from the input port and passing through the input rail 701 may be transmitted to the output port P5. In addition, an input signal transmitted from the input port and passing through the input rail 701 is divided at a first division point 731 into a signal directed to the output ports P1 and P3 and a signal directed to the output ports P2 and P4. The first division point 731 may refer to the center of the portion where the phase changing rail 721 and the connection rail 711 are coupled to each other.

Thereafter, the signal that has passed through a first section 741-1 of the connection rail 711 and directed to the output ports P2 and P4 is divided again at a second division point 732 into a signal transmitted to the output port P2 and a signal transmitted to the output port P4. The second division point 732 may refer to a point where the connection rail 711, the connection rail 712, and the output rail 705 are connected to each other. In addition, the signal that has passed a second section 741-2 of the connection rail 711 and directed to the output ports P1 and P3 is divided again at a third division point 733 into a signal transmitted to the output port P1 and a signal transmitted to the output port P3. The third division point 733 may refer to a point where the connection rail 711, the connection rail 713, and the output rail 704 are connected to each other. The first section 741-1 may refer to the portion that ranges from the first division point 731 to the second division point 732 in the connection rail 711. The second section 741-2 may refer to the portion that ranges from the first division point 731 to the third division point 733 in the connection rail 711.

The signal transmitted to the output port P2 passes through a third section 742-1 in FIG. 7B and FIG. 7C and a fourth section 742-2 in FIG. 7B and FIG. 7C of the connection rail 712, and the signal transmitted to the output port P4 passes through the output rail 705. The third section 742-1 may refer to a portion where the coupling with the output rail 703 is released in the phase changing rail 722 as the first board 211 rotates. The fourth section 742-2 may refer to a portion where the coupling with the connection rail 713 is released in the phase changing rail 723 as the first board 211 rotates.

In some embodiments, when the first board 211 rotates as indicated by the arrow designated as "Movement Section", the third section 742-1 and the fourth section 742-2 may be different from each other in the amount of change in the length thereof because the arc length of the first board 211 varies depending on the radius thereof during the rotation of the first board 211. Thus, as the first board 211 rotates, the phase change amounts of the signals passing through the third section 742-1 and the fourth section 742-2 may be different from each other. In some embodiments, since the length of the phase changing rail 721 is greater than that of the phase changing rail 321 shown in FIG. 3B, the amount of change in the length of the first section 741-1 in FIG. 7B may be greater than the amount of change in the length of the first section 341-1 in FIG. 3B according to the rotation of the first board 211. Thus, although the connection rail 711 does not have a comb-line shape, the phase change amount of the signal passing through the first section 741-1 in FIG. 7B according to the rotation of the first board 211 may be greater than that of the signal passing through the first section 341-1 in FIG. 3B.

The signal transmitted to the output port P1 passes through a fifth section 743-1 in FIG. 7A and FIG. 7B and a sixth section 743-2 in FIG. 7A and FIG. 7B in the connection rail 713, and the signal transmitted to the output port P3 passes through the output rail 704. The fifth section 743-1 may refer to a candidate portion that may be further coupled to the output rail 702 in the phase changing rail 723 when the first board 211 rotates. The sixth section 743-2 may refer to a candidate portion that may be further coupled to the connection rail 713 in the phase changing rail 723 when the first board 211 rotates.

In such a case, the lengths of the input rail 701 and the output rail 706 do not vary when the first board 211 rotates. As a result, the phase of the signal transmitted to the output port P5 after the rotation of the first board 211 does not vary, compared to that before the rotation of the first board 211.

In addition, as the first board 211 rotates, the length of the first section 741-1 increases by the rotation angle of the first board 211. Accordingly, the phase of the signal passing through the first section 741-1 and heading for the output ports P2 and P4 increases by a first phase (α°).

As the first board 211 rotates, the lengths of the third section 742-1 and the fourth section 742-2 increase by the rotation angle of the first board 211, respectively. Thus, the phase of the signal passing through the third section 742-1 and the fourth section 742-2 and transmitted to the output port P2 increases by a second phase (β°). The increased second phase (β°) may be the sum of the phase increments by the third section 742-1 and the fourth section 742-2, respectively. As a result, the phase of the signal transmitted to the output port P2 after the rotation of the first board 211 varies by +α°+β°, compared to that before the rotation of the first board 211.

In addition, as the first board 211 rotates, the length of the output rail 705 does not vary, so that the phase of the signal transmitted to the output port P4 after the rotation of the first board 211 varies by +α°, compared to that before the rotation of the first board 211.

On the other hand, as the first board 211 rotates, the length of the second section 741-2 decreases by the rotation angle of the first board 211. Thus, the phase of the signal passing through the second section 741-2 and heading for the output ports P1 and P3 decreases by a first phase (α°).

As the first board 211 rotates, the lengths of the fifth section 743-1 and the sixth section 743-2 decrease by the rotation angle of the first board 211, respectively. Thus, the phase of the signal passing through the fifth section 743-1 and the sixth section 743-2 and transmitted to the output port P1 decreases by a second phase (β°). The decreased second phase (β°) may be the sum of the phase decrements by the fifth section 743-1 and the sixth section 743-2, respectively. As a result, the phase of the signal transmitted to the output port P1 after the rotation of the first board 211 varies by −α°−β°, compared to that before the rotation of the first board 211.

In addition, as the first board 211 rotates, the length of the output rail 704 does not vary, so that the phase of the signal transmitted to the output port P3 after the rotation of the first board 211 varies by −α°, compared to that before the rotation of the first board 211.

In such a case, it can be seen that the phase change amount (−α°−β°) of the signal transmitted to the output port P1 and the phase change amount (+α°−β°) of the signal transmitted to the output port P2, according to the rotation of the first board 211, have a symmetrical relationship with each other. In addition, it can be seen that the phase change amount (−α°) of the signal transmitted to the output port P3 and the phase change amount (+α°) of the signal transmitted to the output port P4, according to the rotation of the first board 211, have a symmetrical relationship with each other.

When changing the phases of the signals transmitted to the respective output ports according to the rotation of the first board 211, the first section 741-1 may be used to adjust, as well as the phase of the signal transmitted to the output port P2, the phase of the signal transmitted to the output port P4 by the same first phase (α°). That is, since a connection rail for adjusting the phase of the signal transmitted to the output port P2 by the first phase (α°) and a connection rail for adjusting the phase of the signal transmitted to the output port P4 by the first phase (α°) are not separately required, the size of the phase shifter 120 can be reduced.

In this case, the length of the second section 741-2 decreases in response to an increase in the length of the first section 741-1 according to the rotation of the first board 211. That is, the phase of the signal heading for the output ports P1 and P3 reversely varies in response to a change in the phase of the signal heading for the output ports P2 and P4 by the connection rail 711.

As described above, when the first board 211 and the second board 212 have a rail structure as shown in FIGS. 7A and 7C, the phase change amount of a signal transmitted to each output port according to the rotation of the first board 211 may be determined as shown in Table 3 below.

TABLE 3

| Output ports | Phases | |
|---|---|---|
| | Reference | Amount of change |
| P1 | 0° | −α° − β° |
| P2 | 0° | +α° + β° |
| P3 | 0° | −α° |
| P4 | 0° | +α° |
| P5 | 0° | 0° |

Figure 8A:
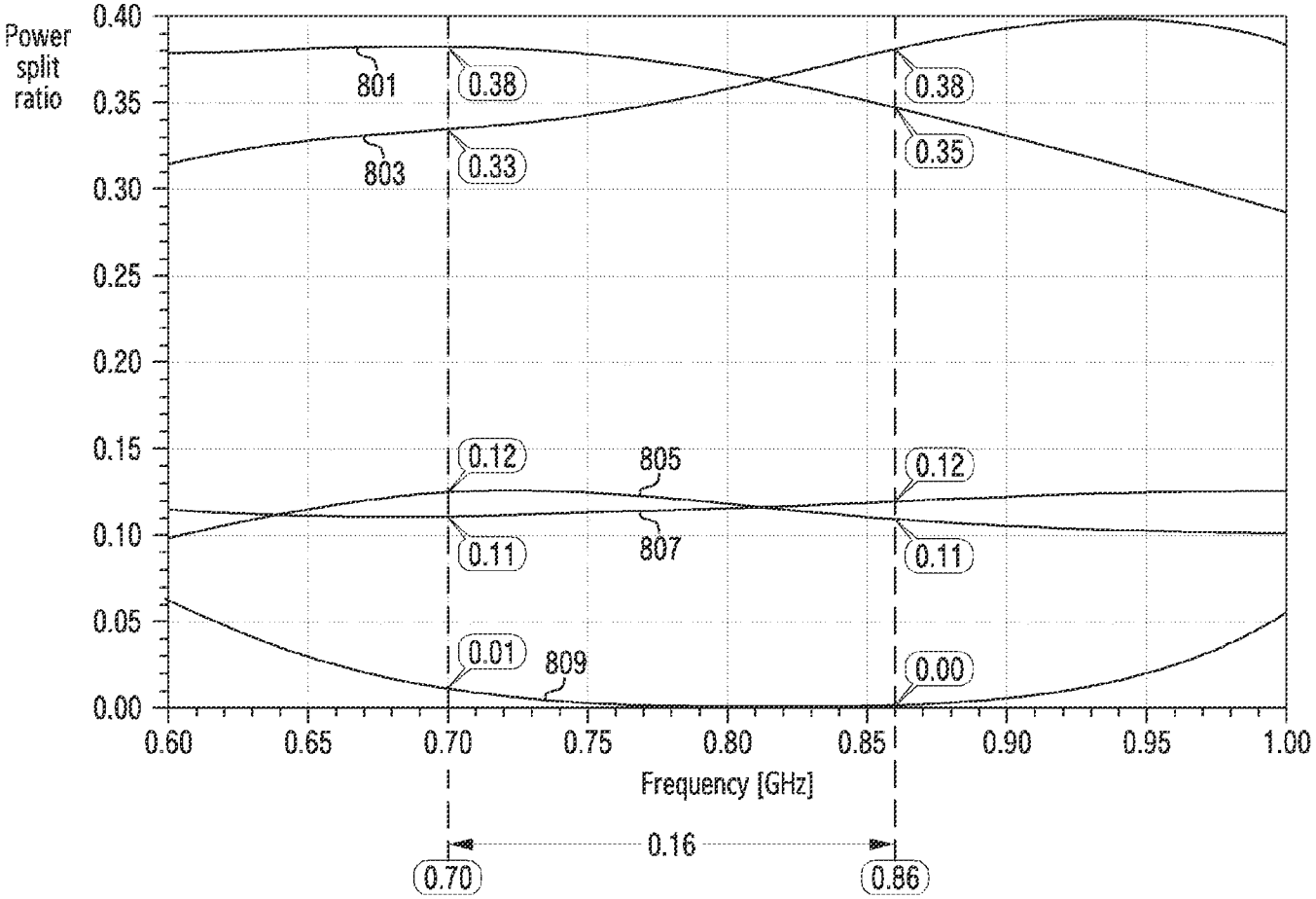
FIG. 8A illustrates a graph for a power split ratio according to a first embodiment of the present disclosure.

FIG. 8A illustrates a graph for a power split ratio according to a first embodiment of the present disclosure.

Referring to FIG. 8A, the x-axis of the power split ratio graph represents a frequency in GHz of a signal transmitted to each output port or input port, and the y-axis thereof represents a power split ratio of a signal transmitted to each output port or input port.

In such a case, a curve 801 represents a power split ratio of a signal transmitted to the output port P1 corresponding to each frequency. A curve 803 represents a power split ratio of a signal transmitted to the output port P2 corresponding to each frequency. A curve 805 represents a power split ratio of a signal transmitted to the output port P3 corresponding to each frequency. A curve 807 represents a power split ratio of a signal transmitted to the output port P4 corresponding to each frequency. A curve 809 represents a power split ratio of a signal transmitted to the input port corresponding to each frequency. For example, if the frequency is 0.7 GHz, the power split ratio of the signal transmitted to output port P1 may be 0.38. If the frequency is 0.7 GHz, the power split ratio of the signal transmitted to the output port P2 may be 0.33. If the frequency is 0.7 GHz, the power split ratio of the signal transmitted to the output port P3 may be 0.12. If the frequency is 0.7 GHz, the power split ratio of the signal transmitted to the output port P4 may be 0.11. If the frequency is 0.7 GHz, the power split ratio of the signal reflected by the input port may be 0.01. If the frequency is shifted by 0.16 GHz to 0.86 GHz, corresponding power split ratios for curves 801, 803, 805, 807 and 809 are also indicated.

Figure 8B:
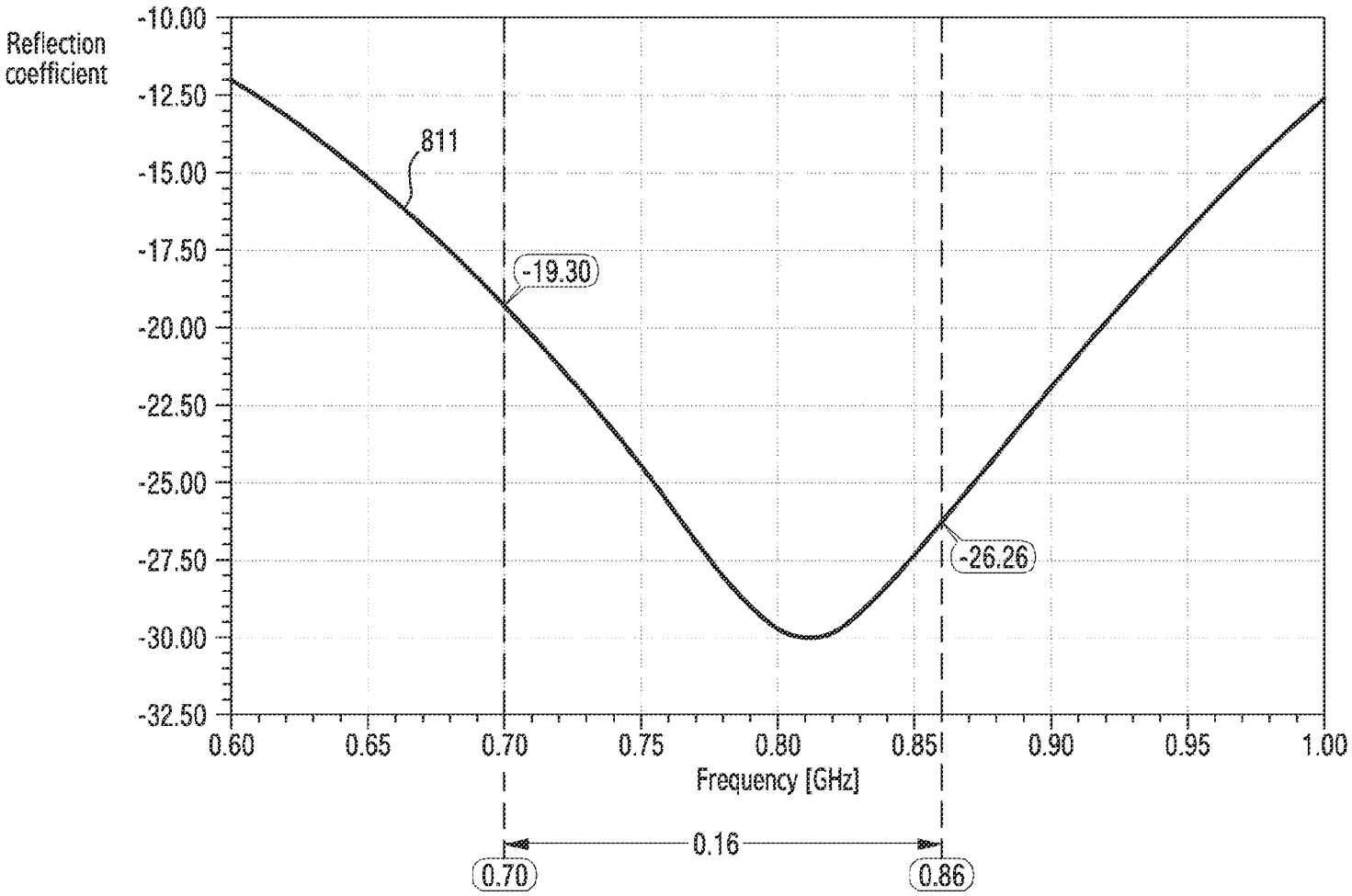
FIG. 8B illustrates an S-parameter graph for the reflection coefficient according to a first embodiment of the present disclosure.

FIG. 8B illustrates an S-parameter graph for the reflection coefficient according to a first embodiment of the present disclosure.

Referring to FIG. 8B, the x-axis of the reflection coefficient graph represents a frequency in GHz of a signal transmitted to the input port, and the y-axis represents a reflection coefficient of a signal transmitted to the input port. Here, the reflection coefficient indicates the ratio of the input voltage to the output voltage of the input port. That is, the reflection coefficient may be the ratio of the voltage input to the input port to the voltage reflected by the input port.

In this case, a curve 811 represents the reflection coefficient for the signal transmitted to the input port depending on respective frequencies. For example, if the frequency of the signal transmitted to the input port is 0.7 GHz, the reflection coefficient for the signal transmitted to the input port may be −19.30. In addition, it can be seen that the reflection coefficient drops sharply in a specific frequency band (for example, 0.7 GHz to 0.86 GHz) a reflection coefficient of −26.26 at 0.86 GHz, which may mean that the input voltage is not reflected and is discharged as much as possible to the outside in the corresponding frequency band. This indicates that the lower the reflection coefficient, the better the radiating characteristic of the beam-tilt antenna. In addition, it is possible to identify a broadband or a narrowband depending on whether the width of the frequency band (e.g., 16 GHz) in which the reflection coefficient drops sharply is wide or narrow.

Figure 9A:
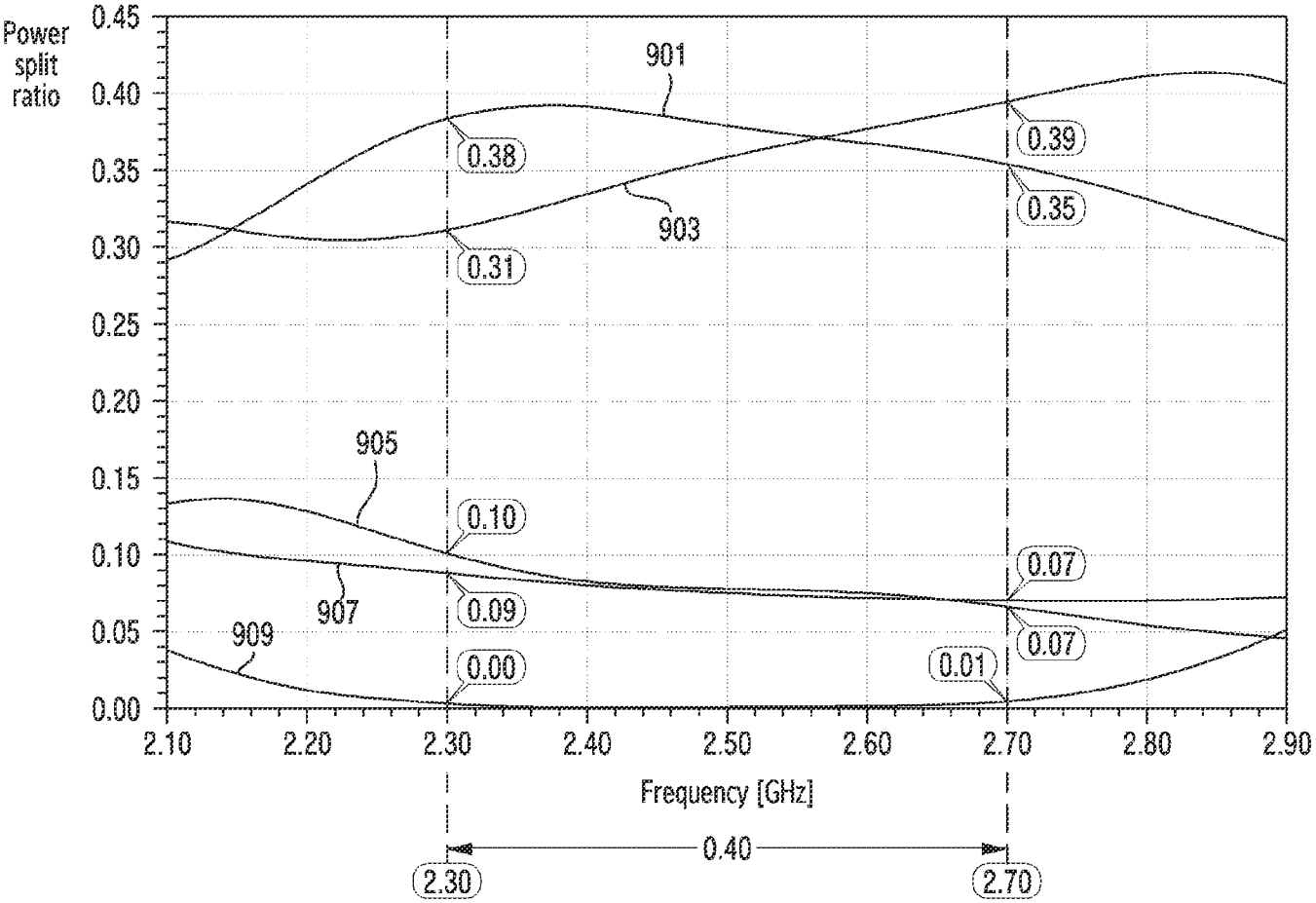
FIG. 9A illustrates a graph for a power split ratio according to a second embodiment of the present disclosure.

FIG. 9A illustrates a graph for a power split ratio according to a second embodiment of the present disclosure.

Referring to FIG. 9A, the x-axis of the power split ratio graph represents the frequency in GHz of a signal transmitted to each output port or input port, and the y-axis thereof represents a power split ratio of a signal transmitted to each output port or input port.

In this case, a curve 901 represents a power split ratio of a signal transmitted to the output port P1 corresponding to each frequency. A curve 903 represents a power split ratio of a signal transmitted to the output port P2 corresponding to each frequency. A curve 905 represents a power split ratio of a signal transmitted to the output port P3 corresponding to each frequency. A curve 907 represents a power split ratio of a signal transmitted to the output port P4 corresponding to each frequency. A curve 909 represents a power split ratio of a signal transmitted to the input port corresponding to each frequency. For example, if the frequency is 2.3 GHz, the power split ratio of the signal transmitted to output port P1 may be 0.38. If the frequency is 2.3 GHz, the power split ratio of the signal transmitted to the output port P2 may be 0.31. If the frequency is 2.3 GHz, the power split ratio of the signal transmitted to the output port P3 may be 0.10. If the frequency is 2.3 GHz, the power split ratio of the signal transmitted to the output port P4 may be 0.09. If the frequency is 2.3 GHz, the power split ratio of the signal reflected by the input port may be 0.001. If the frequency is shifted by 0.4 GHz to 2.7 GHz, corresponding power split ratios for curves 901, 903, 905, 907 and 909 are also indicated.

Figure 9B:
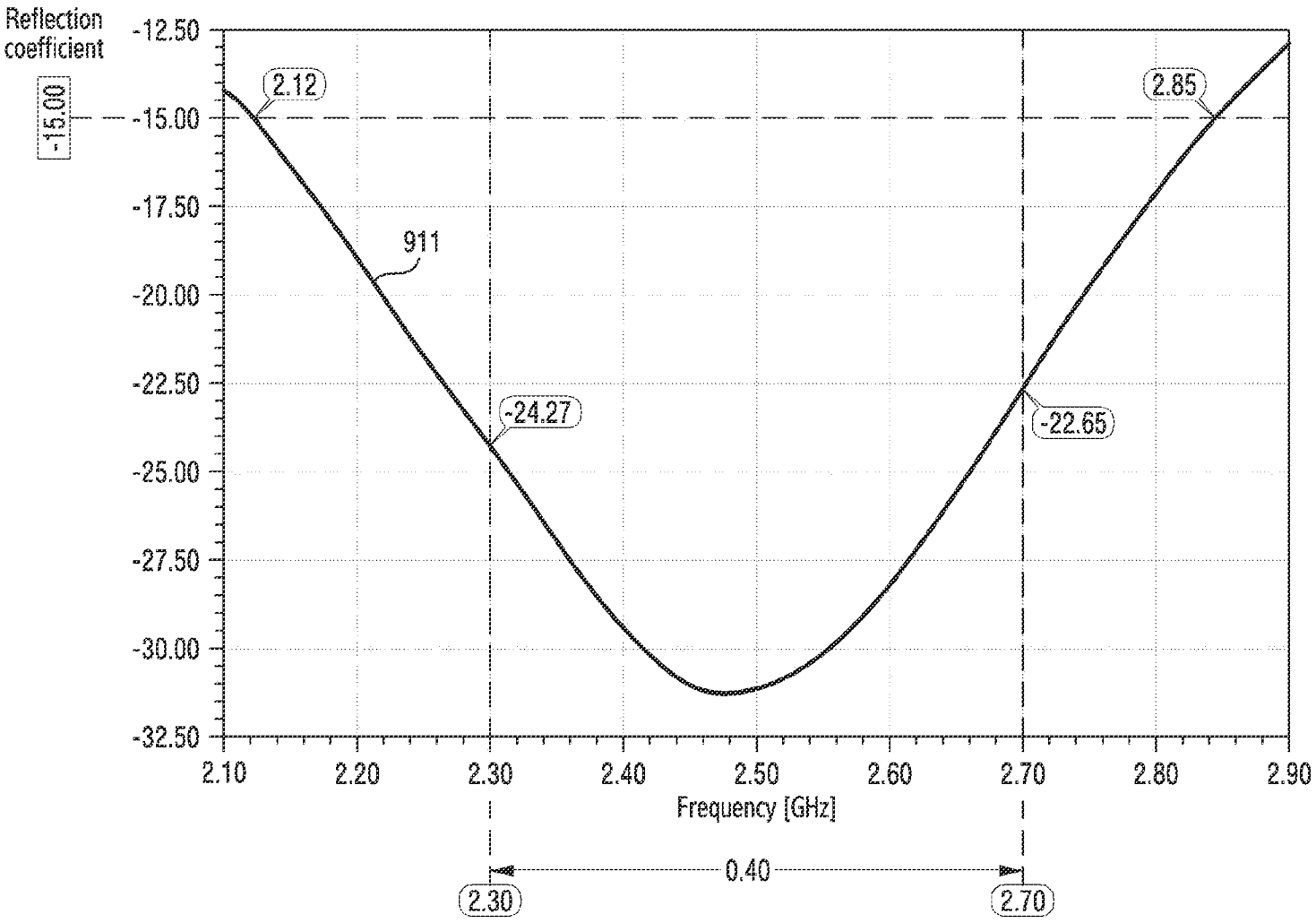
FIG. 9B illustrates an S-parameter graph for the reflection coefficient according to a second embodiment of the present disclosure.

FIG. 9B illustrates an S-parameter graph for the reflection coefficient according to a second embodiment of the present disclosure.

Referring to FIG. 9B, the x-axis of the reflection coefficient graph represents a frequency in GHz of a signal transmitted to the input port, and the y-axis represents a reflection coefficient of a signal reflected by the input port. Here, the reflection coefficient indicates the ratio of the input voltage to the output voltage of the input port. That is, the reflection coefficient may be the ratio of the voltage input to the input port to the voltage output from the input port.

In this case, a curve 911 represents the reflection coefficient for the signal transmitted to the input port depending on respective frequencies such as −15 at 2.12 GHz and 2.85 GHz, as well as −22.65 at 27 GHz. For example, if the frequency of the signal transmitted to the input port is 2.30 GHz, the reflection coefficient for the signal transmitted to the input port may be −24.27. In addition, it can be seen that the reflection coefficient drops sharply in a specific frequency band (for example, of a 0.40 width from 2.30 GHz to 2.70 GHz), which may mean that the input voltage is not reflected and is discharged as much as possible to the outside in the corresponding frequency band. This indicates that the lower the reflection coefficient, the better the radiation characteristic of the beam-tilt antenna 100. For example, the radiating characteristic of the beam-tilt antenna 100 can be satisfied when the reflection coefficient is equal to or less than −15.00.

Figure 10A:
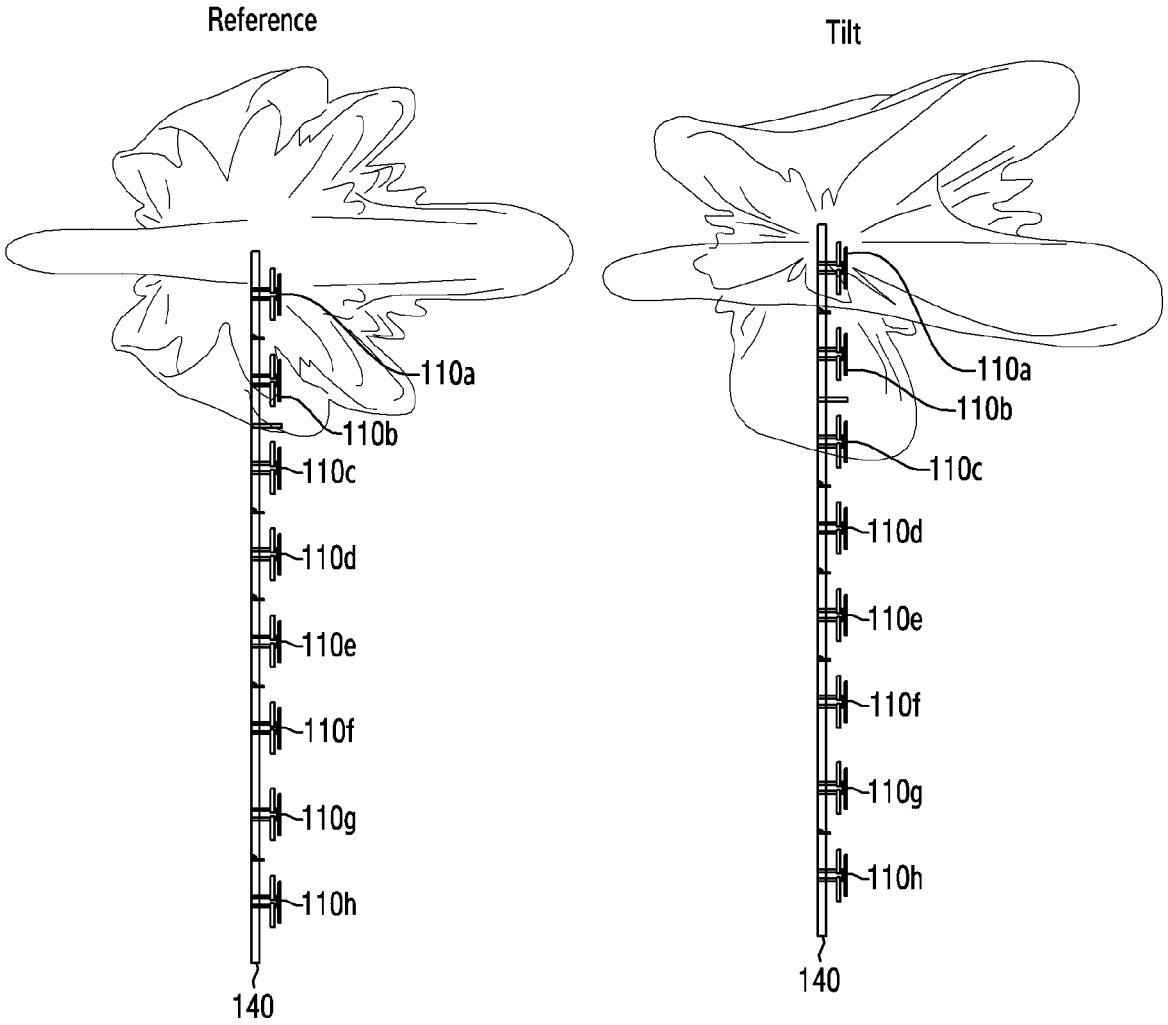
FIG. 10A illustrates an example of a beam pattern change of a beam-tilt antenna depending on a phase change according to a first embodiment of the present disclosure.
Figure 10B:
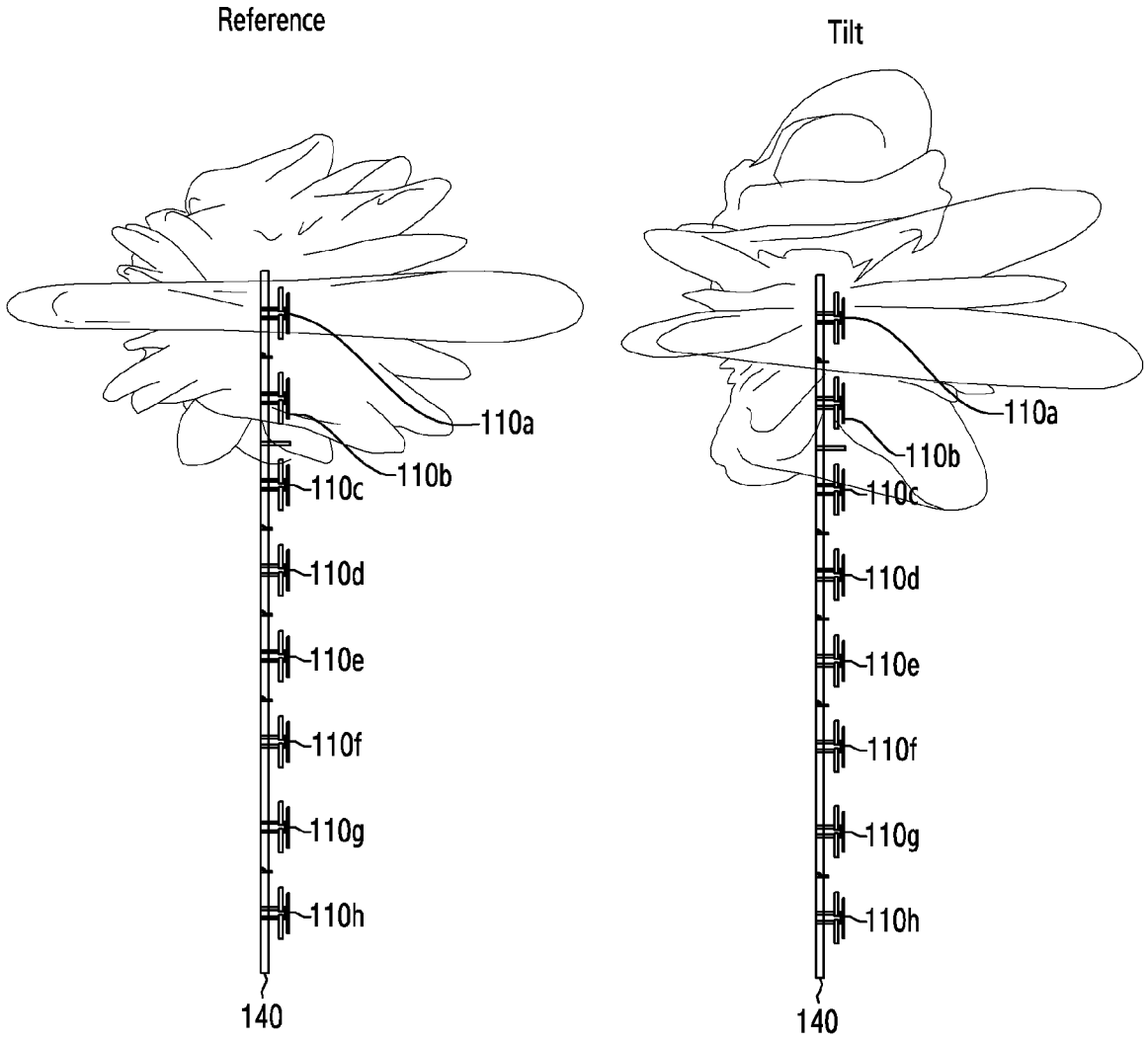
FIG. 10B illustrates an example of a beam pattern change of a beam-tilt antenna depending on a phase change according to a second embodiment of the present disclosure.

FIG. 10A illustrates an example of a beam pattern change from a reference orientation to a tilt orientation of a beam-tilt antenna depending on a phase change according to a first embodiment of the present disclosure. FIG. 10B illustrates an example of a beam pattern change from a reference orientation to a tilt orientation of a beam-tilt antenna depending on a phase change according to a second embodiment of the present disclosure.

Figure 11A:
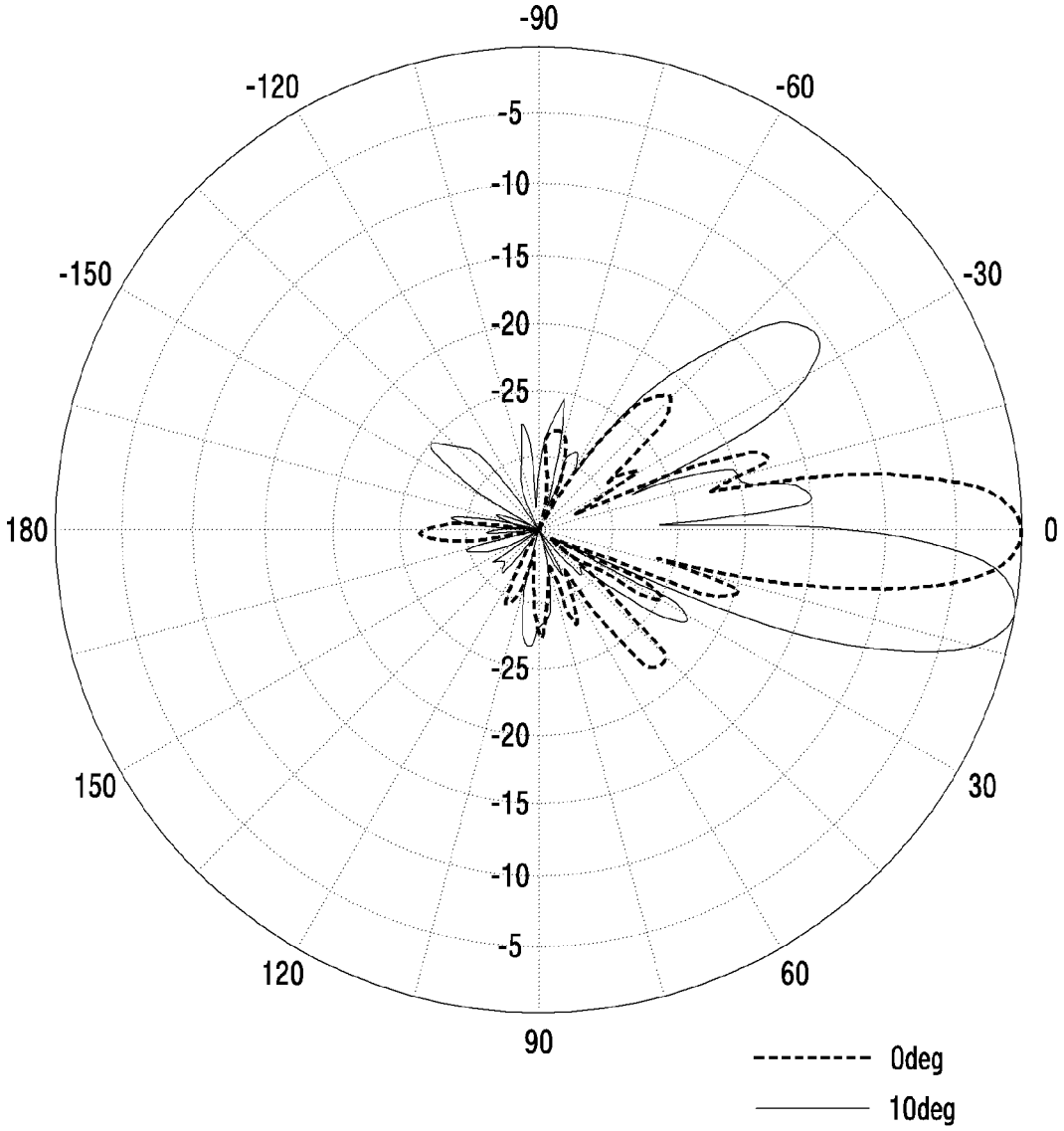
FIG. 11A illustrates a vertical beam pattern characteristic diagram of a beam-tilt antenna according to various embodiments of the present disclosure.
Figure 11B:
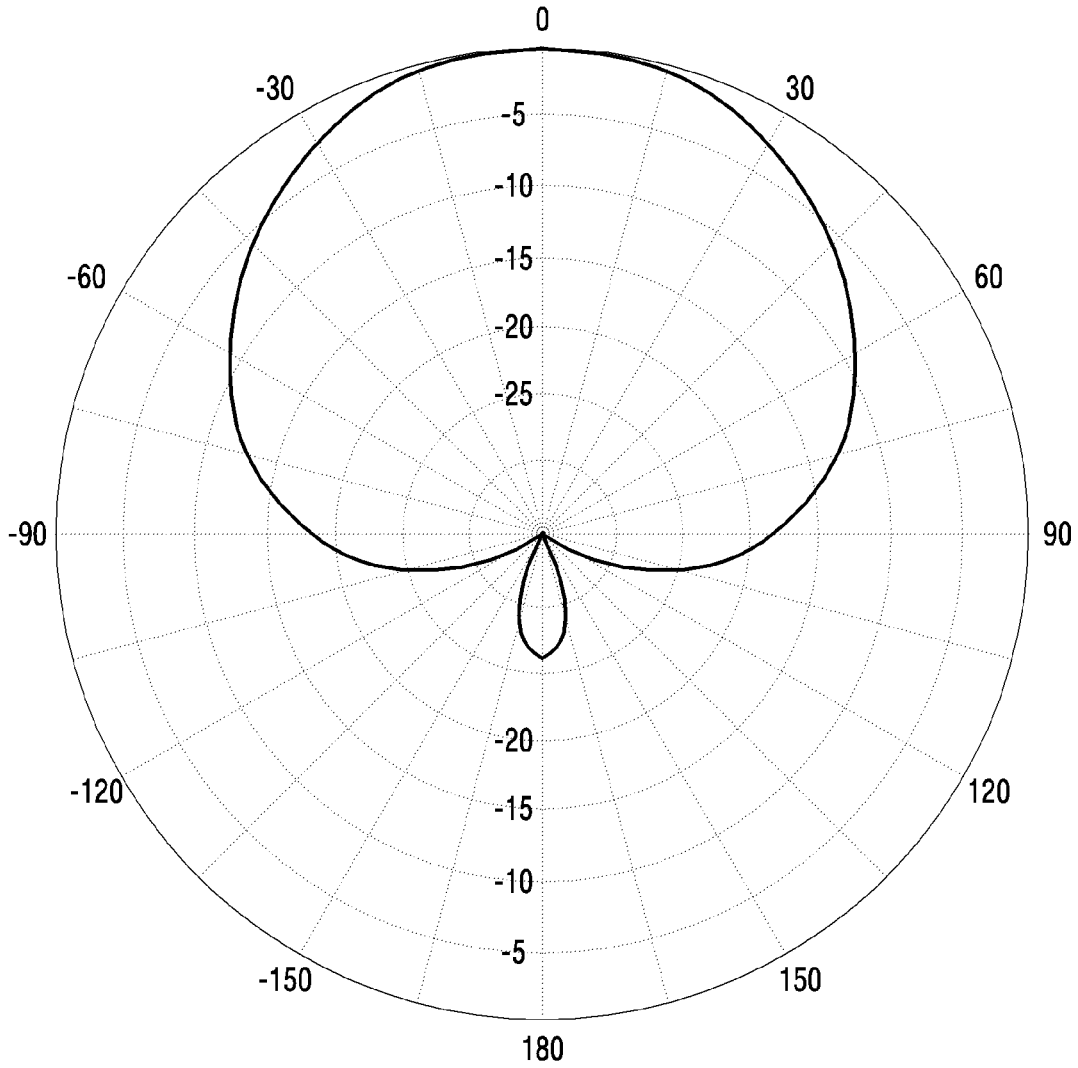
FIG. 11B illustrates a horizontal beam pattern characteristic diagram of a beam-tilt antenna according to various embodiments of the present disclosure.

Referring to FIGS. 10A and 10B, it can be seen that the beam radiated from a radiating element 110*a* through a reflector plate 140 included in the beam-tilt antenna is tilted in the vertical direction when the first board rotates. In such a case, it can be seen that the beam-tilt angles are different between the case where the first board and the second board have the rail structure shown in FIGS. 3A to 3C according to the first embodiment and the case where the first board and the second board have the rail structure shown in FIGS. 5A to 5C according to the second embodiment when the first board rotates at the same angle. For example, referring to FIGS. 11A and 11B, it can be seen that when the first board and the second board have the rail structure shown in FIGS. 3A to 3C according to the first embodiment, the vertical beam pattern is changed from 0° to 10° in FIG. 11A in the vertical beam pattern characteristic diagram of the beam-tilt antenna. In such a case, it is confirmed that the horizontal beam pattern is not changed in the horizontal beam pattern characteristic diagram of the beam-tilt antenna. However, in various embodiments, the horizontal beam pattern in FIG. 11B may also vary depending on various factors such as the orientation of the beam-tilt antenna, the arrangement of the radiating elements 110*a* to 110*h* in FIG. 10A and FIG. 10B, and the like.

Embodiments of the present disclosure provided in the present specifications and drawings are merely certain examples to readily describe the technology associated with embodiments of the present disclosure and to help understanding of the embodiments of the present disclosure, but may not limit the scope of the embodiments of the present disclosure. Therefore, in addition to the embodiments disclosed herein, the scope of the various embodiments of the present disclosure should be construed to include all modifications or modified forms drawn based on the technical idea of the various embodiments of the present disclosure.

In the above-described detailed embodiments of the present disclosure, a component included in the present disclosure is expressed in the singular or the plural according to a presented detailed embodiment. However, the singular form or plural form is selected for convenience of description suitable for the presented situation, and various embodiments of the present disclosure are not limited to a single element or multiple elements thereof. Further, either multiple elements expressed in the description may be configured into a single element or a single element in the description may be configured into multiple elements.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

The invention claimed is:

1. A phase shifter device comprising:

a first board comprising a first phase changing rail, a second phase changing rail, and a third phase changing rail; and a second board comprising:

an input rail, a first output rail, a second output rail, a third output rail, a fourth output rail, and a connection rail configured in a comb-line shape, wherein the first board is disposed to be spaced a predetermined distance apart from the second board so as to face and overlay the second board, wherein the connection rail includes a first division point coupled to the first phase changing rail, a second division point coupled the second phase changing rail, and a third division point coupled to the third phase changing rail, wherein the first division point is connected between the input rail and each of the second division point and the third division point, wherein the first output rail and the third output rail are connected with the second division point, wherein the second output rail and the fourth output rail are connected with the third division point, wherein a first phase variance value for the first output rail and the second output rail according to a rotation of the first board is less than a second phase variance value for the third output rail and the fourth output rail according to the rotation of the first board.

2. The device of claim 1, wherein the second board further comprises a fifth output rail, wherein the fifth output rail is connected to the input rail, and wherein an input signal having passed through the input rail is transmitted to fifth output rail without a phase change.

3. The device of claim 1, wherein the first division point comprises a center point of the connection rail between the second division point and the third division point.

4. The device of claim 1, wherein a length between the first division point and the second division point of the connection rail varies by a rotation angle of the first board.

5. The device of claim 1, further comprising a motor configured to rotate the first board.

6. The device of claim 1, wherein a portion of the second phase changing rail includes a third section coupled to the third output rail, and wherein a portion of the third phase changing rail includes a fourth section coupled to the fourth output rail.

7. The device of claim 6, wherein a phase of a third signal passing through the third section increases by a second value, and wherein a phase of a fourth signal passing through the fourth section decreases by the second value.

8. The device of claim 1, wherein a phase of a first signal passing through a first section of the connection rail increases by a first value, and wherein a phase of a second signal passing through a second section of the connection rail decreases by the first value, wherein the first section is between the first division point and the second division point, and wherein the second section is between the first division point and the third division point.

9. An antenna device comprising:

a housing;

a first radiating element and a second radiating element configured to be disposed inside the housing; and a phase shifter, for changing a phase of one of signals transmitted through the first radiating element and the second radiating element, configured to be disposed inside the housing, wherein the phase shifter includes:

a first board comprising a first phase changing rail, a second phase changing rail, and a third phase changing rail; and a second board comprising:

an input rail, a first output rail, a second output rail, a third output rail, a fourth output rail, and a connection rail configured in a comb-line shape, wherein the first board is disposed to be spaced a predetermined distance apart from the second board so as to face and overlay the second board, wherein the connection rail includes a first division point coupled to the first phase changing rail, a second division point coupled the second phase changing rail, and a third division point coupled to the third phase changing rail, wherein the first division point is connected between the input rail and each of the second division point and the third division point, wherein the first output rail and the third output rail are connected with the second division point, wherein the second output rail and the fourth output rail are connected with the third division point, and wherein a first phase variance value for the first output rail and the second output rail according to a rotation of the first board, is less than a second phase variance value for the third output rail and the fourth output rail according to the rotation of the first board.

10. The device of claim 9, wherein a portion of the second phase changing rail includes a third section coupled to the third output rail, and wherein a portion of the third phase changing rail includes a fourth section coupled to the fourth output rail.

11. The device of claim 10, wherein a phase of a third signal passing through the third section increases by a second value, and wherein a phase of a fourth signal passing through the fourth section decreases by the second value.

12. The device of claim 9, wherein the first division point comprises a center point of the connection rail between the second division point and the third division point.

13. The device of claim 9, wherein a phase of a first signal passing through a first section of the connection rail increases by a first value, and wherein a phase of a second signal passing through a second section of the connection rail decreases by the first value, wherein the first section is between the first division point and the second division point, and wherein the second section is between the first division point and the third division point.

* * * * *